US008882105B2

(12) United States Patent
Iwata

(10) Patent No.: US 8,882,105 B2
(45) Date of Patent: Nov. 11, 2014

(54) SHEET STACKING APPARATUS AND IMAGE FORMING APPARATUS

(71) Applicant: Canon Kabushiki Kaisha, Tokyo (JP)

(72) Inventor: Toshiyuki Iwata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/856,005

(22) Filed: Apr. 3, 2013

(65) Prior Publication Data

US 2013/0285313 A1 Oct. 31, 2013

(30) Foreign Application Priority Data

Apr. 27, 2012 (JP) ..... 2012-103015

(51) Int. Cl.
*B65H 31/36* (2006.01)
*B65H 31/34* (2006.01)

(52) U.S. Cl.
CPC ..... *B65H 31/34* (2013.01); *B65H 31/36* (2013.01)
USPC ..... 271/221; 271/207; 271/213

(58) Field of Classification Search
USPC ..... 271/207, 213, 214, 215, 217, 221
See application file for complete search history.

(56) References Cited

U.S. PATENT DOCUMENTS

| | | | | |
|---|---|---|---|---|
| 6,871,851 | B2 | 3/2005 | Tamura et al. | |
| 7,874,553 | B2 | 1/2011 | Kushida et al. | |
| 8,320,030 | B2 * | 11/2012 | Kimura | 358/498 |
| 8,398,078 | B2 * | 3/2013 | Kotani | 271/221 |
| 8,505,911 | B2 * | 8/2013 | Tamada et al. | 271/213 |
| 2012/0313317 | A1 | 12/2012 | Gamo et al. | |
| 2012/0319346 | A1 | 12/2012 | Iwata et al. | |

* cited by examiner

*Primary Examiner* — Kaitlin Joerger
(74) *Attorney, Agent, or Firm* — Fitzpatrick, Cella, Harper & Scinto

(57) ABSTRACT

Provided is a sheet stacking apparatus including a discharge roller pair, a stacking tray, a tray drive motor, a sheet surface detecting sensor detecting a position of a topmost sheet on the stacking tray, an alignment portion including front and rear alignment members which are provided above the stacking tray and sandwiching a sheet to align, and a finisher control portion executing: raising/lowering control for raising and lowering the stacking tray so that the topmost sheet is located at a predetermined height in accordance with a detection result obtained from the sheet surface detecting sensor; alignment control for aligning the sheet when the sheet is discharged; and alignment stop control for stopping the alignment of the alignment portion in the case that a movement amount of the stacking tray, at the time when the stacking tray moves in accordance with the detection result, exceeds a predetermined movement amount.

31 Claims, 16 Drawing Sheets

SHEET STACKING APPARATUS AND IMAGE FORMING APPARATUS

BACKGROUND OF THE INVENTION

1. Field of the Invention

The present invention relates to a sheet stacking apparatus and an image forming apparatus, and more particularly, to a sheet stacking apparatus capable of aligning sheets stacked on a stacking tray, and an image forming apparatus including the sheet stacking apparatus.

2. Description of the Related Art

In recent years, along with increase in image formation speed, there has been known an image forming apparatus including a sheet stacking apparatus configured to stack a large number of sheets having images formed thereon in an aligned state (see U.S. Pat. No. 6,871,851).

The sheet stacking apparatus disclosed in U.S. Pat. No. 6,871,851 includes a pair of alignment members, and is configured to move the pair of alignment members in a sheet width direction orthogonal to a sheet discharge direction on a stacking tray for stacking sheets thereon, thereby aligning the sheets in the sheet width direction. The sheet stacking apparatus includes a sheet stacking height detecting sensor capable of detecting a top surface position of the sheets on the stacking tray in a sheet stacking height direction. Further, the stacking tray is controlled to be raised and lowered in accordance with a detection result obtained from the sheet stacking height detecting sensor so that the top surface position of the stacked sheets with respect to the sheet discharge portion becomes constant.

In the above-mentioned sheet stacking apparatus, in order to perform the alignment or the like without disturbing the aligned state of the sheets stacked on the stacking tray, one of the alignment members is fixed in a state of abutting against one edge portion of the stacked sheets, and another of the alignment members is brought into abutment against another edge portion of the sheets, to thereby perform the alignment. At the time of such an alignment operation, for example, in a case of forming images on a large number of sheets, a user may take a part of the stacked sheets out from the stacking tray during the image forming job. When the user takes out a part of the stacked sheets, the sheet stacking height detecting sensor detects it and raises the stacking tray to an appropriate position. During a period in which the stacking tray is raised to the appropriate position, however, a gap may be formed between one of the alignment members and the topmost sheet. Under the above-mentioned state, when another of the alignment members is to be brought into abutment against another edge portion of a discharged sheet to align the sheet, the sheet may enter the above-mentioned gap to cause stack misalignment, and in some cases, the sheet may slip out through the gap to drop. This may occur, even in a case where both of the pair of alignment members are moved to align the sheets, for example, when the sheet is discharged while being displaced toward one of the alignment members.

Further, for example, in a case where the sheet is discharged with its leading and trailing edges curved upward, that is, in a concave gutter curl state, when the sheet stacking height detecting sensor detects the trailing edge of the sheet that is curved upward, a position higher than the actual top surface position is detected as the top surface position, and as a result, the stacking tray may be lowered. When the stacking tray is lowered in this state, a gap may be formed between the alignment members and the surface of the sheet, and similarly to the above, the stack misalignment may occur in the sheet or the sheet may drop.

SUMMARY OF THE INVENTION

In view of the above, the present invention provides a sheet stacking apparatus capable of preventing stack misalignment of multiple sheets stacked on a stacking tray, and an image forming apparatus including the sheet stacking apparatus.

According to an exemplary embodiment of the present invention, there is provided a sheet stacking apparatus, including: a sheet discharge portion configured to discharge a sheet; a stacking tray on which the sheet discharged from the sheet discharge portion is stacked; a raising/lowering portion configured to raise and lower the stacking tray in a sheet stacking height direction; a sheet stacking height detecting sensor configured to detect a top surface position of a topmost sheet, which is stacked on the stacking tray, in the sheet stacking height direction; an alignment portion has a first alignment member arranged on one side in a sheet width direction orthogonal to a sheet discharge direction, a second alignment member arranged on another side in the sheet width direction, and the first alignment member and the second alignment member which are provided above the stacking tray and sandwich the sheet to align; and a control portion configured to execute: raising/lowering control for raising and lowering the stacking tray by the raising/lowering portion so that the top surface position of the topmost sheet in the sheet stacking height direction is located at a predetermined height in accordance with a detection result obtained from the sheet stacking height detecting sensor; alignment control for aligning the sheet in the sheet width direction by the alignment portion when the sheet is discharged from the sheet discharge portion; and alignment stop control for stopping an alignment operation of the alignment portion in a case that a movement amount of the stacking tray, at the time when the stacking tray is moved so that the top surface position of the topmost sheet in the sheet stacking height direction is located at the predetermined height in accordance with the detection result obtained from the sheet stacking height detecting sensor, exceeds a predetermined movement amount.

According to another exemplary embodiment of the present invention, there is provided an image forming apparatus, including: an image forming portion configured to form an image on a sheet; a sheet discharge portion configured to discharge the sheet on which the image is formed by the image forming portion; a stacking tray on which the sheet discharged from the sheet discharge portion is stacked; a raising/lowering portion configured to raise and lower the stacking tray in a sheet stacking height direction; a sheet stacking height detecting sensor configured to detect a top surface position of a topmost sheet, which is stacked on the stacking tray, in the sheet stacking height direction; an alignment portion has a first alignment member arranged on one side in a sheet width direction orthogonal to a sheet discharge direction, a second alignment member arranged on another side in the sheet width direction, and the first alignment member and the second alignment member which are provided above the stacking tray and sandwich the sheet to align; and a control portion configured to execute: raising/lowering control for raising and lowering the stacking tray by the raising/lowering portion so that the top surface position of the topmost sheet in the sheet stacking height direction is located at a predetermined height in accordance with a detection result obtained from the sheet stacking height detecting sensor; alignment control for aligning the sheet in the sheet width direction by the alignment portion when the sheet is discharged from the sheet discharge portion; and alignment stop control for stopping an alignment operation of the alignment portion in a case that a movement amount of the stacking tray, at the time when the stacking tray is moved so that the top surface position of the topmost sheet in the sheet stacking height direction is located at the predetermined height in accordance with the detection result obtained from the sheet stacking height detecting sensor, exceeds a predetermined movement amount.

According to the present invention, the alignment stop control is executed when the stacking tray moves over the predetermined movement amount. Accordingly, it is possible to prevent the stack misalignment of multiple sheets stacked on the stacking tray.

Further features of the present invention will become apparent from the following description of exemplary embodiments with reference to the attached drawings.

DESCRIPTION OF THE EMBODIMENTS

In the following, an image forming apparatus including a sheet stacking apparatus according to an exemplary embodiment of the present invention is described with reference to the attached drawings. The image forming apparatus according to this embodiment is typified by a copying machine, a printer, a facsimile machine, and a multifunction peripheral combining those apparatus, and includes a sheet stacking apparatus capable of an alignment process for sheets stacked on a stacking tray. In the embodiment described below, a monochrome/color multifunction peripheral (hereinafter referred to as "multifunction peripheral") 1 is used as the image forming apparatus.

Figure 1:
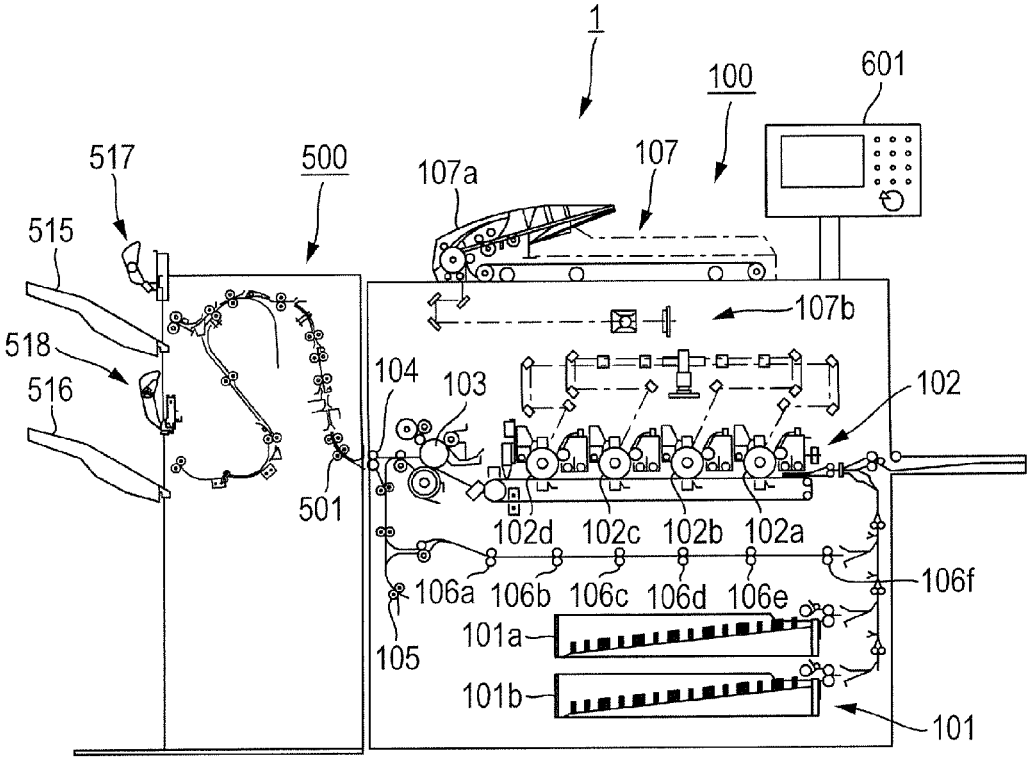
FIG. 1 is a schematic sectional view illustrating the entire structure of a multifunction peripheral according to an embodiment.
Figure 2:
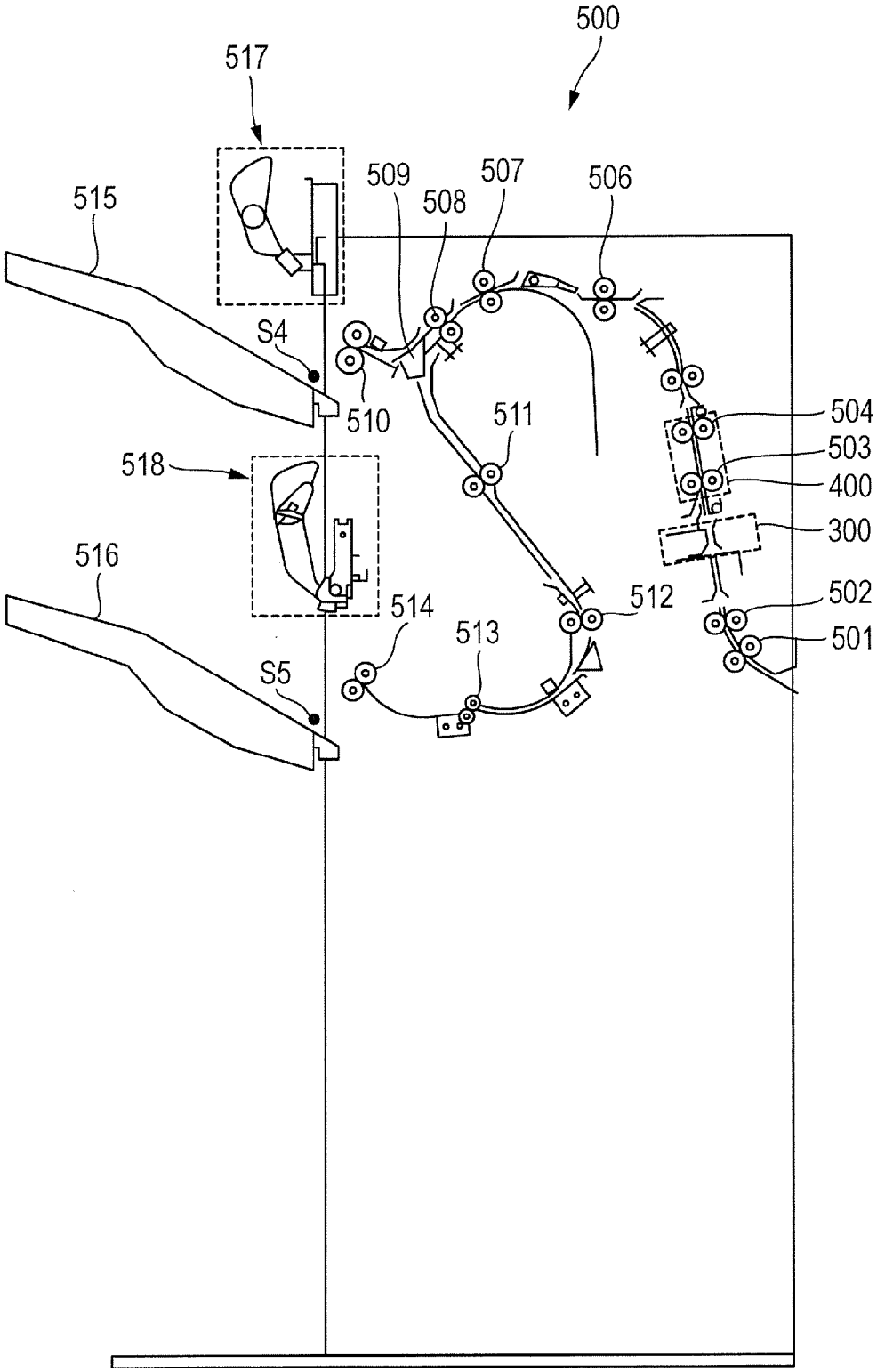
FIG. 2 is a schematic sectional view illustrating the entire structure of a finisher according to the embodiment.

The multifunction peripheral 1 according to the embodiment of the present invention is described with reference to FIGS. 1 to 16B. First, referring to FIGS. 1 and 2, the entire structure of the multifunction peripheral according to this embodiment is described based on movement of a sheet. FIG. 1 is a schematic sectional view illustrating the entire structure of the multifunction peripheral 1 according to the embodiment of the present invention. FIG. 2 is a schematic sectional view illustrating the entire structure of a finisher 500 according to this embodiment.

As illustrated in FIG. 1, the multifunction peripheral 1 according to this embodiment includes a copying machine 100 configured to form an image on a sheet, and the finisher 500 serving as the sheet stacking apparatus connected to the copying machine 100. The finisher 500 according to this embodiment is removable from the copying machine 100, and is usable as an option for the copying machine 100 that is solely usable as well. Further, the finisher 500 according to this embodiment performs an alignment process on multiple sheets having images formed thereon. The alignment process is performed in accordance with settings input by a user through use of an operation portion 601 provided to the copying machine 100.

This embodiment is described with use of the above-mentioned removable finisher 500, but in the multifunction peripheral of the present invention, the copying machine 100 and the finisher 500 may be integrated with each other. In the following, the "front" of the multifunction peripheral 1 refers to such a position that a user faces an operation portion 601 to be used for inputting and setting various items for the multifunction peripheral 1, and the "rear" refers to a position on the rear surface side of the multifunction peripheral. That is, FIG. 1 illustrates the internal structure of the multifunction peripheral 1 as seen from the front side, and the finisher 500 is connected to the side portion of the copying machine 100.

The copying machine 100 includes a sheet containing portion 101 configured to contain sheets, an image forming portion 102 configured to form an image on each sheet contained in the sheet containing portion 101, a fixing portion 103 configured to fix the image formed by the image forming portion 102, and an image reading device 107 configured to read an image of an original.

The image reading device 107 includes an original feeding portion 107*a* configured to feed an original automatically, and an original reading portion 107*b* configured to read the original. Image information of the original that is read by the original reading portion 107*b* is sent to the image forming portion 102. The image forming portion 102 includes photosensitive drums 102*a* to 102*d* on which yellow, magenta, cyan, and black toner images are to be formed, respectively. The image forming portion 102 forms the toner images of the respective colors on the photosensitive drums 102*a* to 102*d* based on the image information that is read by the original reading portion 107*b*.

The sheet containing portion 101 includes cassettes 101*a* and 101*b* configured to contain sheets. In parallel to an image forming operation, the sheet containing portion 101 feeds a sheet contained in any one of the cassettes 101*a* and 101*b* to the image forming portion 102 at a predetermined timing. When the sheet is fed to the image forming portion 102, the toner images of the respective colors that are formed on the photosensitive drums 102*a* to 102*d* are sequentially transferred onto the sheet in a superimposed manner, and thus an unfixed toner image is formed on the sheet. When the sheet is then conveyed to the fixing portion 103 provided on a downstream side of the image forming portion 102 in the sheet conveyance direction, the unfixed toner image is fixed by the fixing portion 103, and the sheet is sent into the finisher 500 by a discharge roller pair 104.

In a case of duplex printing, the sheet is reversed by reversing rollers 105, and the reversed sheet is then conveyed again to the image forming portion 102 by conveyance rollers 106*a* to 106*f* provided to a reverse conveyance path. Then, the above-mentioned operation is repeated.

The finisher 500 is connected to the downstream side of the discharge roller pair 104 in a sheet discharge direction. The multiple sheets sent from the copying machine 100 are introduced to the finisher 500. Based on a setting or the like input from the operation portion 601, a predetermined sheet process can be performed.

As illustrated in FIG. 2, the sheet sent from the copying machine 100 is first delivered to an inlet roller pair 501 provided on an upstream side of the finisher 500. At this time, an inlet sensor (not shown) detects a timing of the sheet delivery at the same time. The sheet delivered to the inlet roller pair 501 is conveyed to a conveying roller pair 502, and a lateral registration detecting unit 300 detects a lateral registration error in a sheet width direction (hereinafter referred to simply as "width direction"). When the lateral registration detecting unit 300 detects the lateral registration error, a shift unit 400 performs shift operation for moving the sheet by a predetermined amount.

After that, the sheet is conveyed along the sheet conveyance path sequentially by conveyance roller pairs 506 to 508, and further conveyed to an upper stacking tray 515 or a lower stacking tray 516 through switching of the conveyance direction by a switching flapper 509. For example, when the switching flapper 509 is switched to the upper stacking tray 515 side, the sheet is discharged onto the upper stacking tray 515 by a discharge roller pair 510 serving as a sheet discharge portion. When the switching flapper 509 is switched to the lower stacking tray 516 side, on the other hand, the sheet is conveyed sequentially by conveyance roller pairs 511 to 513, and discharged onto the lower stacking tray 516 by a discharge roller pair 514 serving as the sheet discharge portion.

The sheet discharged onto the upper stacking tray 515 moves, due to the self-weight of the sheet, to an upstream side in the sheet discharge direction (hereinafter referred to simply as "discharge direction") on a stacking surface, that is inclined downward on the upstream side in the discharge direction, along the stacking surface. The sheet then stops in abutment against an abutment member (not shown) provided on the upstream side at a position below the discharge roller pair 510, and in this manner, the sheet is aligned in the discharge direction. When the sheet is aligned in the discharge direction, the sheet is aligned in the width direction by an upper tray alignment portion 517 serving as an alignment portion. Similarly, the sheet discharged onto the lower stacking tray 516 moves, due to the self-weight of the sheet, to the upstream side in the discharge direction on a stacking surface 516*a*, that is inclined downward on the upstream side in the discharge direction, along the stacking surface 516*a*. The sheet then stops in abutment against an abutment member (not shown) provided on the upstream side at a position below the discharge roller pair 514, and in this manner, the sheet is aligned in the discharge direction. When the sheet is aligned in the discharge direction, the sheet is aligned in the width direction by a lower tray alignment portion 518 serving as the alignment portion. The upper tray alignment portion 517 and the lower tray alignment portion 518, and the upper stacking tray 515 and the lower stacking tray 516 are described later in detail.

Figure 3:
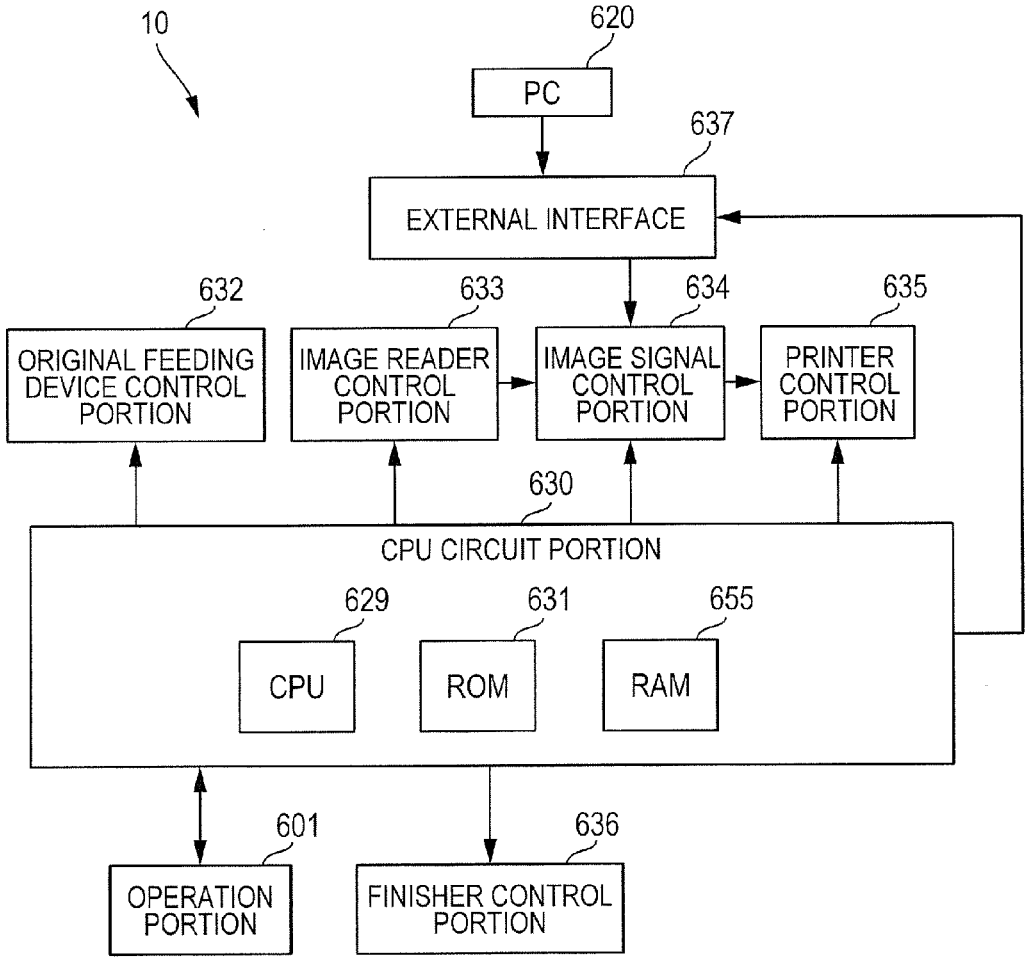
FIG. 3 is a block diagram of a control portion configured to control the multifunction peripheral according to the embodiment.
Figure 4:
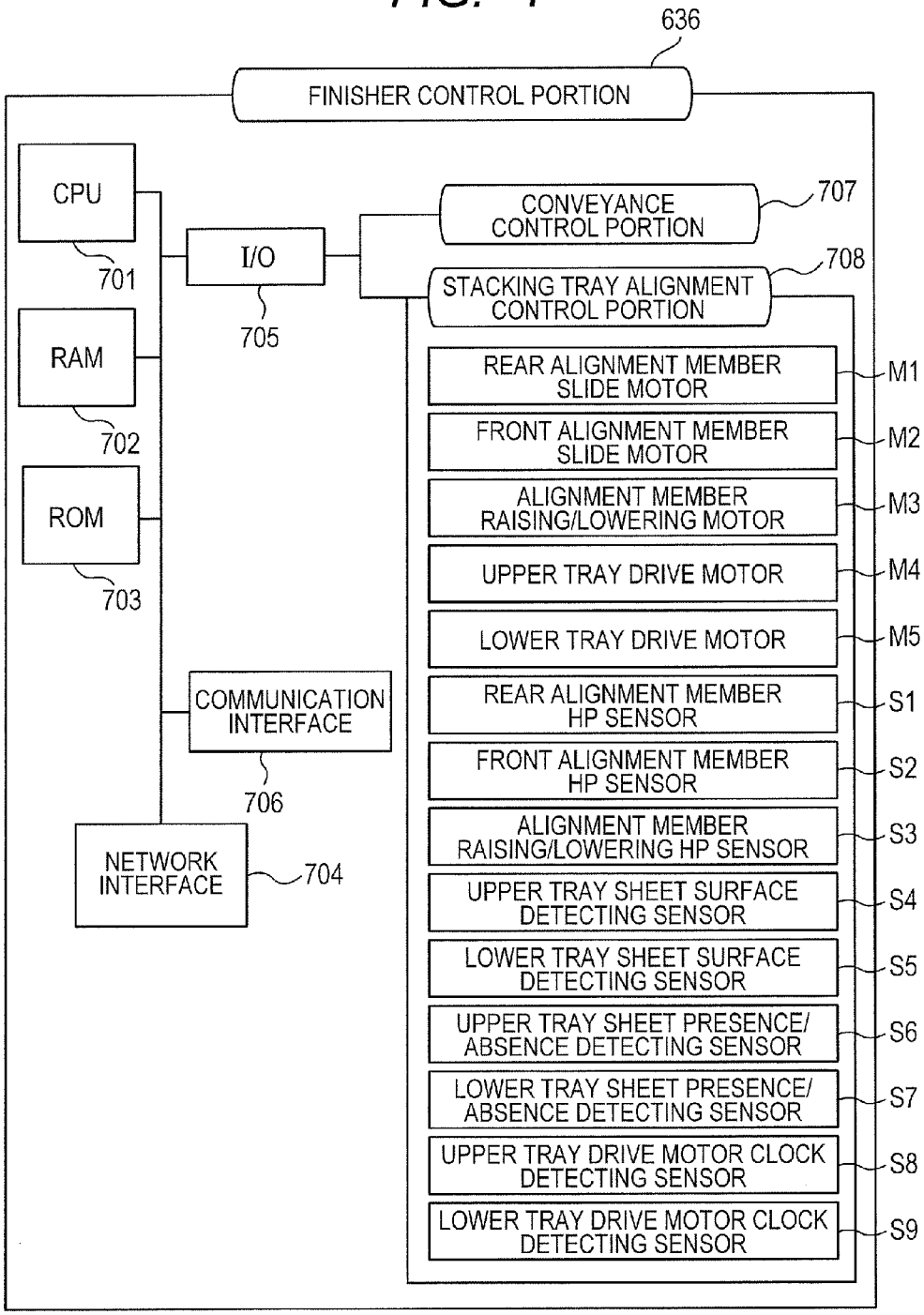
FIG. 4 is a block diagram of a finisher control portion configured to control the finisher according to the embodiment.

Next, a control portion 10 of the multifunction peripheral 1 according to this embodiment is described with reference to FIGS. 3 and 4. FIG. 3 is a block diagram of the control portion 10 of the multifunction peripheral 1 according to this embodiment. FIG. 4 is a block diagram of a finisher control portion 636 configured to control the finisher 500 according to this embodiment.

As illustrated in FIG. 3, the control portion 10 includes a CPU circuit portion 630, an original feeding device control portion 632, an image reader control portion 633, an image signal control portion 634, a printer control portion 635, and the finisher control portion 636. In this embodiment, the CPU circuit portion 630, the original feeding device control portion 632, the image reader control portion 633, the image signal control portion 634, and the printer control portion 635 are mounted to the copying machine 100, and the finisher control portion 636 is mounted to the finisher 500.

The CPU circuit portion 630 includes a CPU 629, a ROM 631, and a RAM 655. The CPU 629 controls the original feeding device control portion 632, the image reader control portion 633, the image signal control portion 634, the printer control portion 635, and the finisher control portion 636, in accordance with programs stored in the ROM 631 and setting input from the operation portion 601. The RAM 655 is used as an area for temporarily holding control data, and a working area for computation to be performed along with the control.

The original feeding device control portion 632 controls the original feeding portion 107*a*, and the image reader control portion 633 controls the original reading portion 107*b* configured to read information on an original that is fed from the original feeding portion 107*a* (see FIG. 1). The data on the original that is read by the image reader control portion 633 is output to the image signal control portion 634. The printer control portion 635 controls the copying machine 100. An external interface 637 is an interface for connecting an external computer (PC) 620 and the copying machine 100 to each other. For example, the external interface 637 expands print data input from the external computer 620 as an image and outputs to the image signal control portion 634. The image data output to the image signal control portion 634 is output to the printer control portion 635, and an image is formed by the image forming portion 102.

As illustrated in FIG. 4, the finisher control portion 636 includes a CPU (microcomputer) 701, a RAM 702, a ROM 703, input/output (I/O) portion 705, a communication interface 706, and a network interface 704. Further, the finisher control portion 636 includes a conveyance control portion 707, and a stacking tray alignment control portion 708. The finisher control portion 636 exchanges information with the CPU circuit portion 630 to control various drive motors and sensors illustrated in FIG. 4, and is capable of executing control of a sheet stacking operation and the like described later by the finisher 500.

For example, in accordance with a detection result obtained from a lower tray sheet surface detecting sensor S5, the finisher control portion 636 executes raising/lowering control for raising and lowering the lower stacking tray 516 so that the top surface position of the topmost sheet in a sheet stacking height direction is located at a predetermined height, or executes alignment control for aligning the sheet discharged onto the lower stacking tray 516 in the width direction. Further, when the movement amount of the lower stacking tray 516 that moves in accordance with the detection result obtained from the lower tray sheet surface detecting sensor S5 exceeds a predetermined movement amount, the finisher control portion 636 executes alignment stop control for stopping the alignment operation of the lower tray alignment portion 518.

Figure 5A:
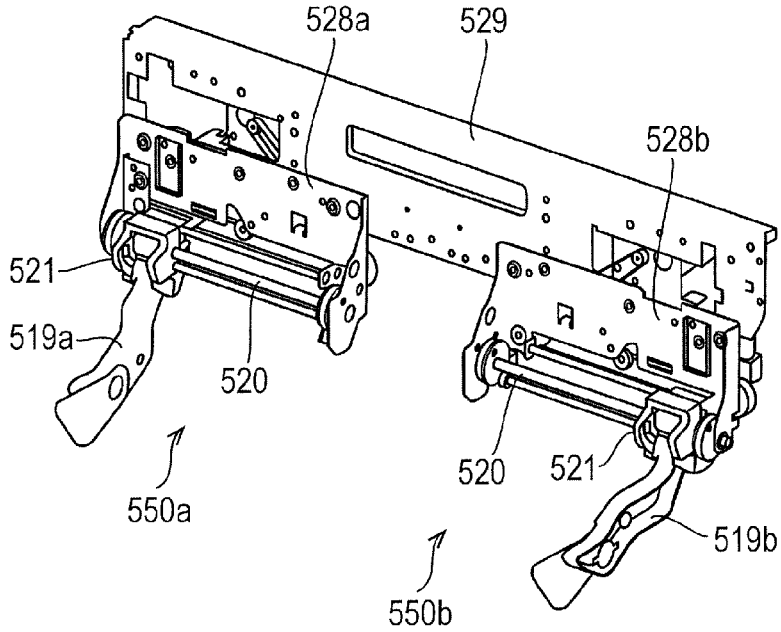
FIGS. 5A and 5B are perspective views illustrating a lower tray alignment portion of the finisher according to the embodiment.
Figure 5B:
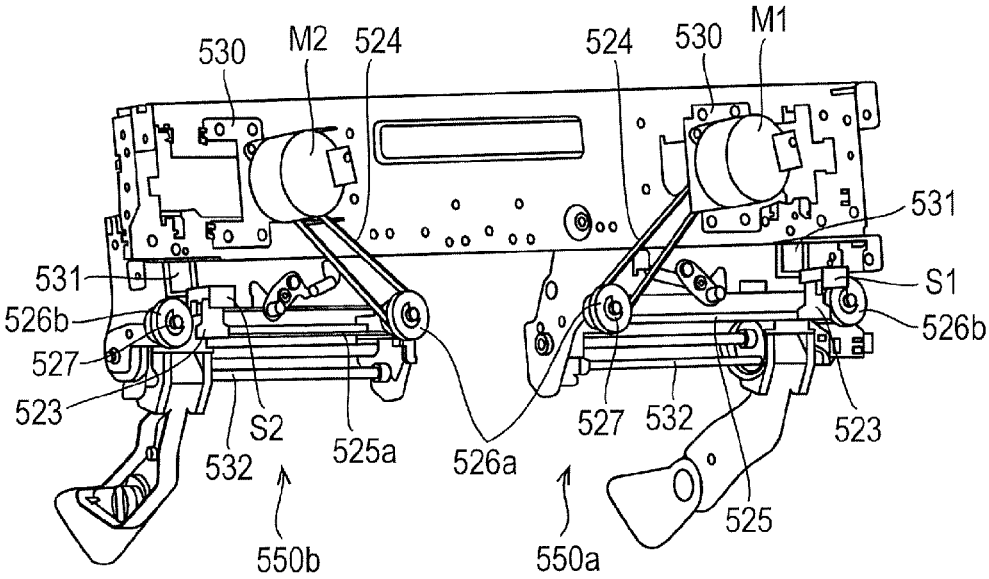
Figure 6A:
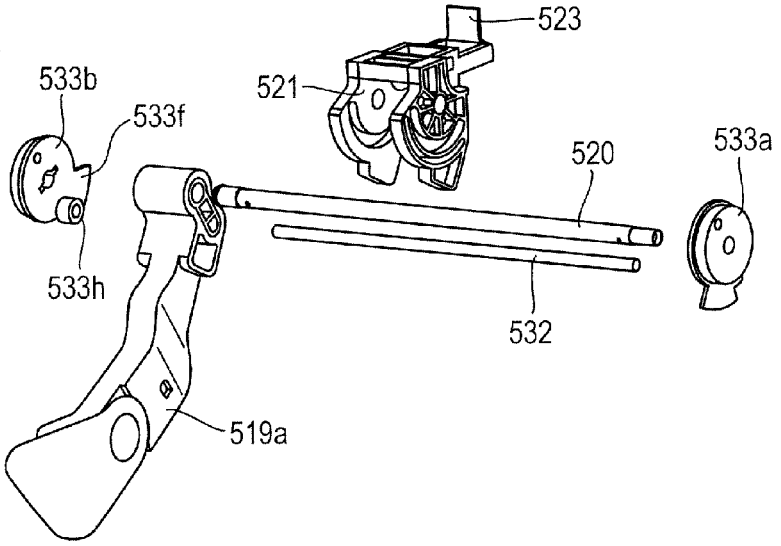
FIGS. 6A, 6B, and 6C are explanatory views illustrating a raising/lowering mechanism for a rear alignment member of the lower tray alignment portion according to the embodiment.
Figure 6B:
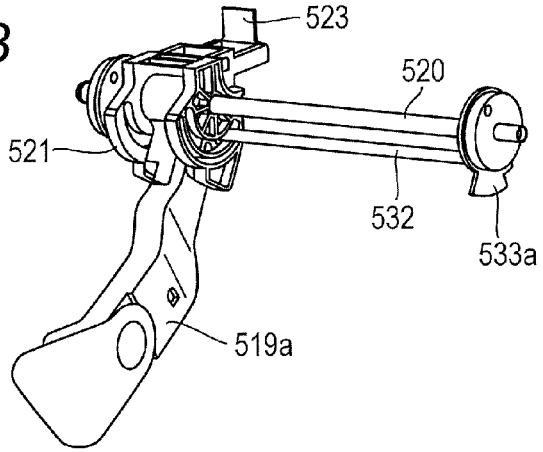
Figure 6C:
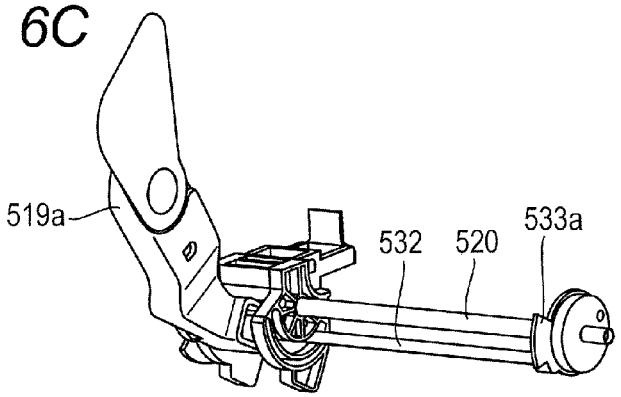
Figure 7A:
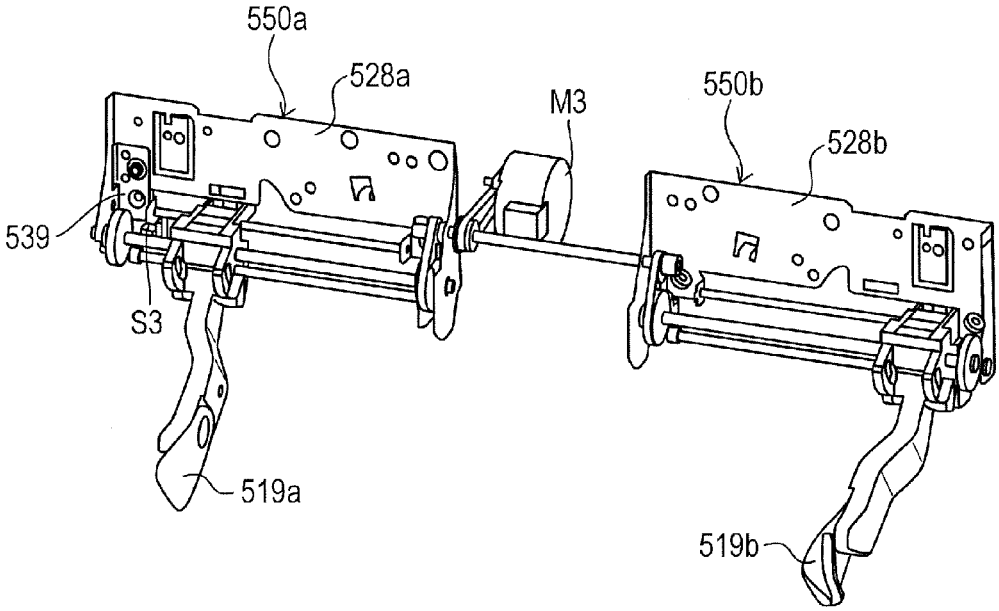
FIGS. 7A and 7B illustrate a drive mechanism configured to drive the raising/lowering mechanism for the rear alignment member according to the embodiment.
Figure 7B:
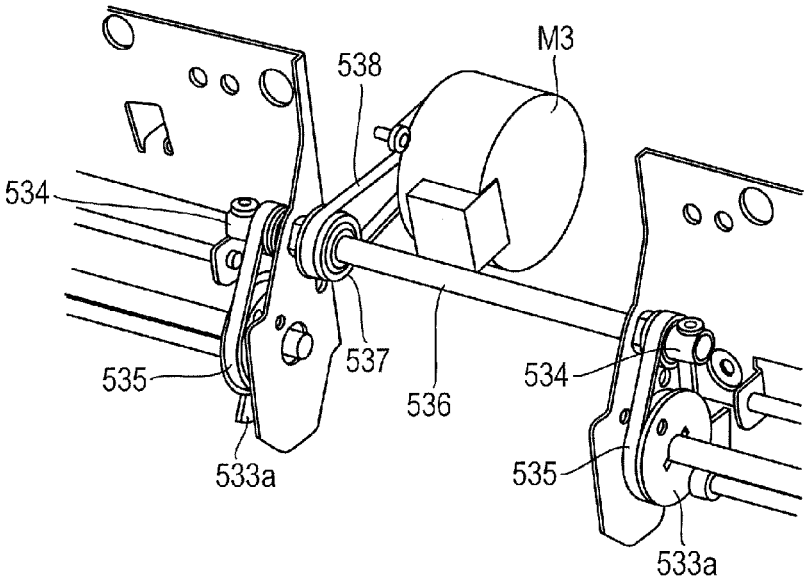

Next, the upper tray alignment portion 517 and the lower tray alignment portion 518 of the finisher 500 according to this embodiment are described with reference to FIGS. 5A to 7B in addition to FIG. 2. FIGS. 5A and 5B are perspective views illustrating the lower tray alignment portion 518 of the finisher 500 according to this embodiment. FIGS. 6A to 6C illustrate a raising/lowering mechanism for a rear alignment member 519*a* of the lower tray alignment portion 518 according to this embodiment. FIGS. 7A and 7B illustrate a drive mechanism configured to drive the raising/lowering mechanism for the rear alignment member 519*a* according to this embodiment. The upper tray alignment portion 517 and the lower tray alignment portion 518 have the same structure. Therefore, the description is directed to the case of the lower tray alignment portion 518, and description of the upper tray alignment portion 517 is omitted herein. In the following, the width direction is referred to as "front-rear direction".

As illustrated in FIG. 2, the lower tray alignment portion 518 is provided above the lower stacking tray 516. As illustrated in FIGS. 5A and 5B, the lower tray alignment portion 518 includes a front alignment unit 550*b* arranged on the front side as one side, a rear alignment unit 550*a* arranged on the rear side as another side, and an upper stay 529. Further, the lower tray alignment portion 518 includes an alignment member raising/lowering motor M3 (see FIGS. 7A and 7B), and an alignment member raising/lowering HP sensor S3 (see FIG. 7A). The front alignment unit 550*b* and the rear alignment unit 550*a* are mounted symmetrically in the front-rear direction with respect to the upper stay 529, and the upper stay 529 is supported by the finisher 500.

The front alignment unit 550*b* includes a front alignment member 519*b* as an first alignment member, a pulley support plate 528*b*, a front alignment member slide motor M2, and a front alignment member HP sensor S2. The rear alignment unit 550*a* includes a rear alignment member 519*a* as a second alignment member, a pulley support plate 528*a*, a rear alignment member slide motor M1, and a rear alignment member HP sensor S1. When the front alignment member 519*b* and the rear alignment member 519*a* sandwich the sheet discharged onto the lower stacking tray 516, the sheet is aligned in the width direction. The front alignment unit 550*b* and the rear alignment unit 550*a* basically have the same structure. Therefore, the structure of the rear alignment unit 550*a* is described herein. For the front alignment unit 550*b*, the same reference symbols are used, and description thereof is therefore omitted herein.

The rear alignment member 519*a* has a proximal end portion that is rotatably and slidably supported by a first alignment spindle 520 together with a slide member 521. The slide member 521 sandwiches a second slide drive transmission belt 525 with a slide position detecting member 523, and the second slide drive transmission belt 525 is looped around a pair of slide drive transmission pulleys 526*a* and 526*b*. The slide drive transmission pulley 526*a* is rotatably supported by a pulley spindle 527 coupled by caulking to the pulley support plate 528*a*, and is also engaged with a first slide drive transmission belt 524. The first slide drive transmission belt 524 is engaged with the rear alignment member slide motor M1. The rear alignment member 519*a* is structured as described above, and hence moves in the front-rear direction along the first alignment spindle 520 together with the slide member 521 by the drive of the rear alignment member slide motor M1.

The pulley support plate 528*a* is mounted to the upper stay 529, and the rear alignment member slide motor M1 is mounted to the upper stay 529 through an intermediation of a slide drive motor support plate 530. The rear alignment member HP sensor S1 is mounted to the upper stay 529 through an intermediation of an alignment position detecting support plate 531, and is configured to detect a home position of the rear alignment member 519*a*. The front alignment member HP sensor S2 is also mounted to the upper stay 529 through an intermediation of an alignment position detecting support plate 531. The rear alignment member 519*a* and the front alignment member 519*b* become paired and slide in the width direction orthogonal to the sheet discharge direction, to thereby align the sheet.

As illustrated in FIGS. 6A to 6C, the first alignment spindle 520 has both ends inserted through the centers of a pair of alignment member raising/lowering pulleys 533*a* and 533*b*, respectively. The pair of alignment member raising/lowering pulleys 533*a* and 533*b* has hole portions 533*h* and 533*h* formed at positions offset from the centers, and both ends of a second alignment spindle 532 are inserted through the hole portions 533*h* and 533*h*, respectively. The second alignment spindle 532 supports the proximal end portion of the rear alignment member 519*a* so as to be movable along engagement grooves of the slide member 521. As illustrated in FIG. 7B, the alignment member raising/lowering pulley 533*a* on the front side is connected to a second raising/lowering pulley 534 through an intermediation of a drive transmission belt 535. The second raising/lowering pulley 534 is connected to a raising/lowering transmission shaft 536 in a D-cut shape on both the front and rear sides thereof, and a third raising/lowering pulley 537 is connected to the raising/lowering transmission shaft 536. The third raising/lowering pulley 537 is connected to the alignment member raising/lowering motor M3 through an intermediation of a drive transmission belt 538.

The rear alignment member 519*a* has a distal end portion which is raised (pivoted) for as much as the pair of alignment member raising/lowering pulleys 533*a* and 533*b* is rotated about the first alignment spindle 520 by the drive of the alignment member raising/lowering motor M3 and the second alignment spindle 532 is pivoted accordingly (see FIG. 6C). At this time, the pivot amount is restricted when the second alignment spindle 532 is engaged with the end portions of the respective engagement grooves of the slide member 521.

When the pair of alignment member raising/lowering pulleys 533*a* and 533*b* is rotated, a flag portion 533*f* of the pair of alignment member raising/lowering pulleys 533*a* and 533*b* turns ON and OFF the alignment member raising/lowering HP sensor S3 configured to detect a raising/lowering position of the rear alignment member 519*a*. Accordingly, the raising/lowering position of the rear alignment member 519*a* is detected, and in accordance with a detection result, the rear alignment member 519*a* is controlled. The rear alignment member 519*a* and the front alignment member 519*b* are coupled to each other through an intermediation of the raising/lowering transmission shaft 536. Therefore, the front alignment member 519*b* is synchronized with the operation of raising and lowering the rear alignment member 519*a*.

Through the operation described above, the sheet is stacked on the lower stacking tray 516 while the rear alignment member 519*a* and the front alignment member 519*b* align the sheet in the width direction. After a predetermined number of sheets are stacked as designated by the user (after the job is ended), the rear alignment member 519*a* and the front alignment member 519*b* are pivoted upward to be retreated from their receiving positions.

Figure 8A:
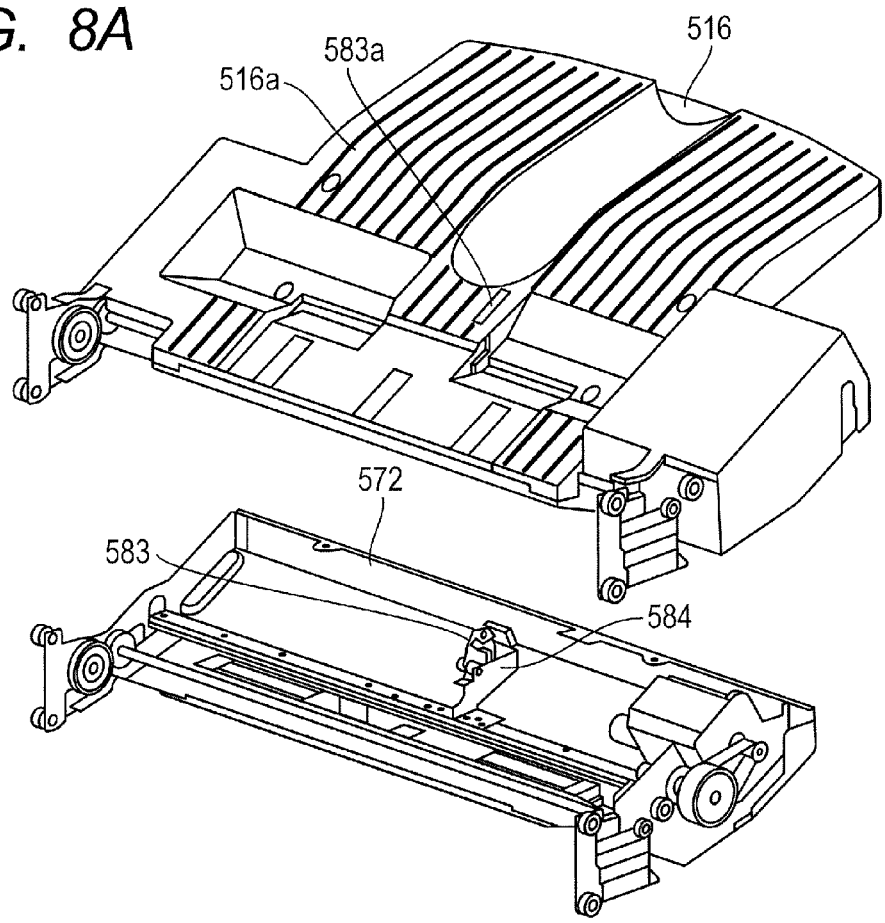
FIGS. 8A and 8B are perspective views illustrating a lower stacking tray of the finisher according to the embodiment.
Figure 8B:
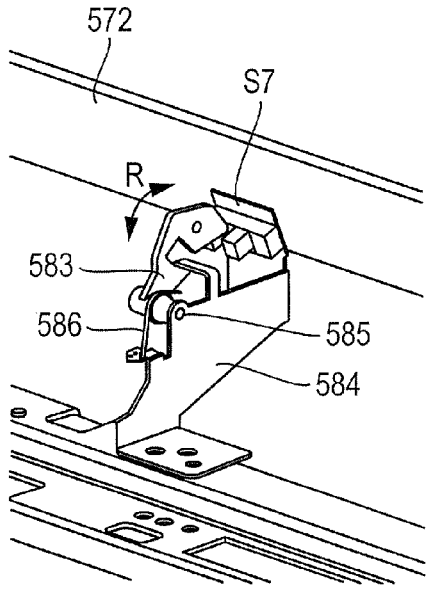
Figure 9A:
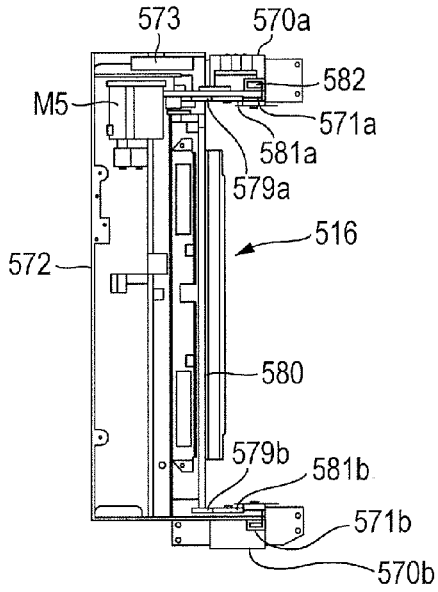
FIGS. 9A, 9B, and 9C illustrate a raising/lowering mechanism for the lower stacking tray of the finisher according to the embodiment.
Figure 9B:
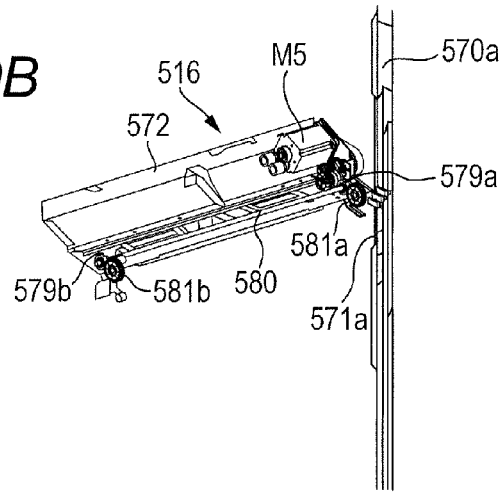
Figure 9C:
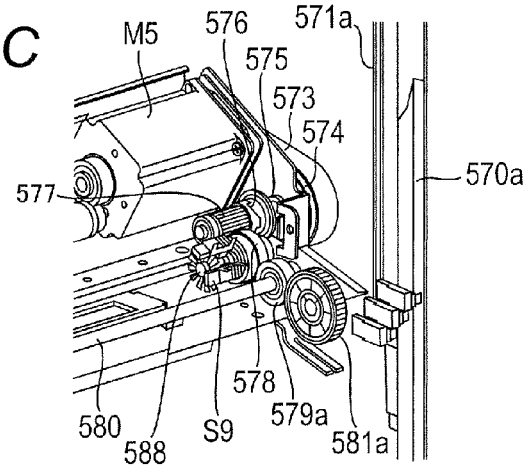

Next, the upper stacking tray 515 and the lower stacking tray 516 of the finisher 500 according to this embodiment are described with reference to FIGS. 8A and 8B and 9A to 9C. The upper stacking tray 515 and the lower stacking tray 516 have the same structure. Therefore, the description is directed to the case of the lower stacking tray 516, and description of the upper stacking tray 515 is omitted herein. FIGS. 8A and 8B are perspective views illustrating the lower stacking tray 516 of the finisher 500 according to this embodiment. FIGS. 9A to 9C are illustrations of a raising/lowering mechanism for the lower stacking tray 516 of the finisher 500 according to this embodiment.

As illustrated in FIG. 8A, an opening portion 583*a* is formed in the stacking surface 516*a* of the lower stacking tray 516. The opening portion 583*a* is formed so that a sheet presence/absence detecting flag 583 can protrude therethrough. The sheet presence/absence detecting flag 583 is mounted to a base plate 572 through an intermediation of a sheet presence/absence detecting plate 584, and is supported to be pivotable in the arrow R direction of FIG. 8B about a rotation center that is a flag rotation shaft 585 coupled by caulking to the sheet presence/absence detecting plate 584. The sheet presence/absence detecting flag 583 is biased by a rotation spring 586 to be brought into a protruding state, and in this state, a distal end portion of the sheet presence/absence detecting flag 583 protrudes through the opening portion 583*a*.

When the sheet presence/absence detecting flag 583 is held in the protruding state, a lower tray sheet presence/absence detecting sensor S7 is brought into an OFF state, and the stacking tray alignment control portion 708 determines that no sheet is present on the lower stacking tray 516. When a sheet is stacked on the lower stacking tray 516, the sheet presence/absence detecting flag 583 is pivoted due to the weight of the sheet so that the lower tray sheet presence/absence detecting sensor S7 is brought into an ON state, and the stacking tray alignment control portion 708 determines that a sheet is present on the lower stacking tray 516.

As illustrated in FIGS. 9A to 9C, the lower stacking tray 516 is supported to be capable of raising and lowering along racks 571*a* and 571*b* provided vertically to frames 570*a* and 570*b* of the finisher 500. Further, the lower stacking tray 516 includes a lower tray drive motor M5 that is a stepper motor, and the lower tray drive motor M5 is mounted to the base plate 572 of the lower stacking tray 516. The lower tray drive motor M5 is connected to a pulley 574 through an intermediation of a timing belt 573, and the pulley 574 is connected to a shaft 575 with a parallel pin. The shaft 575 is connected to a ratchet 576 with a parallel pin, and the ratchet 576 is connected to an idler gear 577 under a state in which the ratchet 576 is biased by a spring (not shown). The idler gear 577 meshes with a gear 578, and the gear 578 meshes with a gear 579*a*. The gear 579*a* meshes with a pinion gear 581*a*, and the pinion gear 581*a* meshes with the rack 571*a*. Further, the gear 579*a* is connected to a gear 579*b* through an intermediation of a shaft 580, and the gear 579*b* meshes with a pinion gear 581*b*. The pinion gear 581*b* meshes with the rack 571*b*.

The lower stacking tray 516 is supported substantially horizontally on the racks 571*a* and 571*b* under a state in which the pinion gear 581*a* meshes with the rack 571*a* and the pinion gear 581*b* meshes with the rack 571*b*, and is raised and lowered in the vertical direction by the drive of the lower tray drive motor M5. The components ranging from the lower tray drive motor M5 to the pinion gears 581*a* and 581*b* are constructed as a unit together with the base plate 572 and a sheet support plate (not shown) mounted to the base plate 572, to thereby serve as a raising/lowering portion together with the racks 571*a* and 571*b*.

The lower stacking tray 516 is raised and lowered in accordance with the top surface position of the topmost sheet in the sheet stacking height direction on the lower stacking tray 516, which is detected by the lower tray sheet surface detecting sensor S5 serving as a sheet stacking height detecting sensor. In this embodiment, the lower tray sheet surface detecting sensor S5 is constructed of an optical sensor including a light emitting portion and a light receiving portion.

A position at which the lower stacking tray 516 or the sheet (sheet bundle) stacked on the lower stacking tray 516 blocks an optical axis of light to be received by the light receiving portion is set as the home position of the lower stacking tray 516. When a sheet is stacked, the lower stacking tray 516 is lowered by a predetermined amount from the home position to a position at which the light receiving portion receives the optical axis, and a succeeding sheet is stacked at the position thus lowered. When a sheet is stacked and the optical axis is therefore blocked by the stacked sheet, the lower stacking tray 516 is lowered again by the predetermined amount to a position at which the light receiving portion receives the optical axis. Through repetition of the above-mentioned operation, the top surface position of the topmost sheet in the sheet stacking height direction on the lower stacking tray 516 becomes constant, and the distance between the discharge roller pair 514 and the topmost sheet becomes constant. For example, in a case where the sheets are taken out from the lower stacking tray 516, the lower stacking tray 516 is raised to a position at which the optical axis is blocked again so that the lower stacking tray 516 is moved to the home position, and then the above-mentioned operation is repeated.

A lower tray drive motor clock detecting sensor S9 (see FIG. 9C) configured to detect clock information of the lower tray drive motor M5 is provided to the lower stacking tray 516, and the position of the lower stacking tray 516 can be detected based on the detected clock count. Note that, in this embodiment, the lower tray drive motor clock detecting sensor S9 counts the clock by detecting flag portions of a rotational flag 588 that is mounted coaxially with the gear 578. The stacking tray alignment control portion 708 monitors the movement amount (raising amount and lowering amount) of the lower stacking tray 516 based on the clock count.

Figure 10:
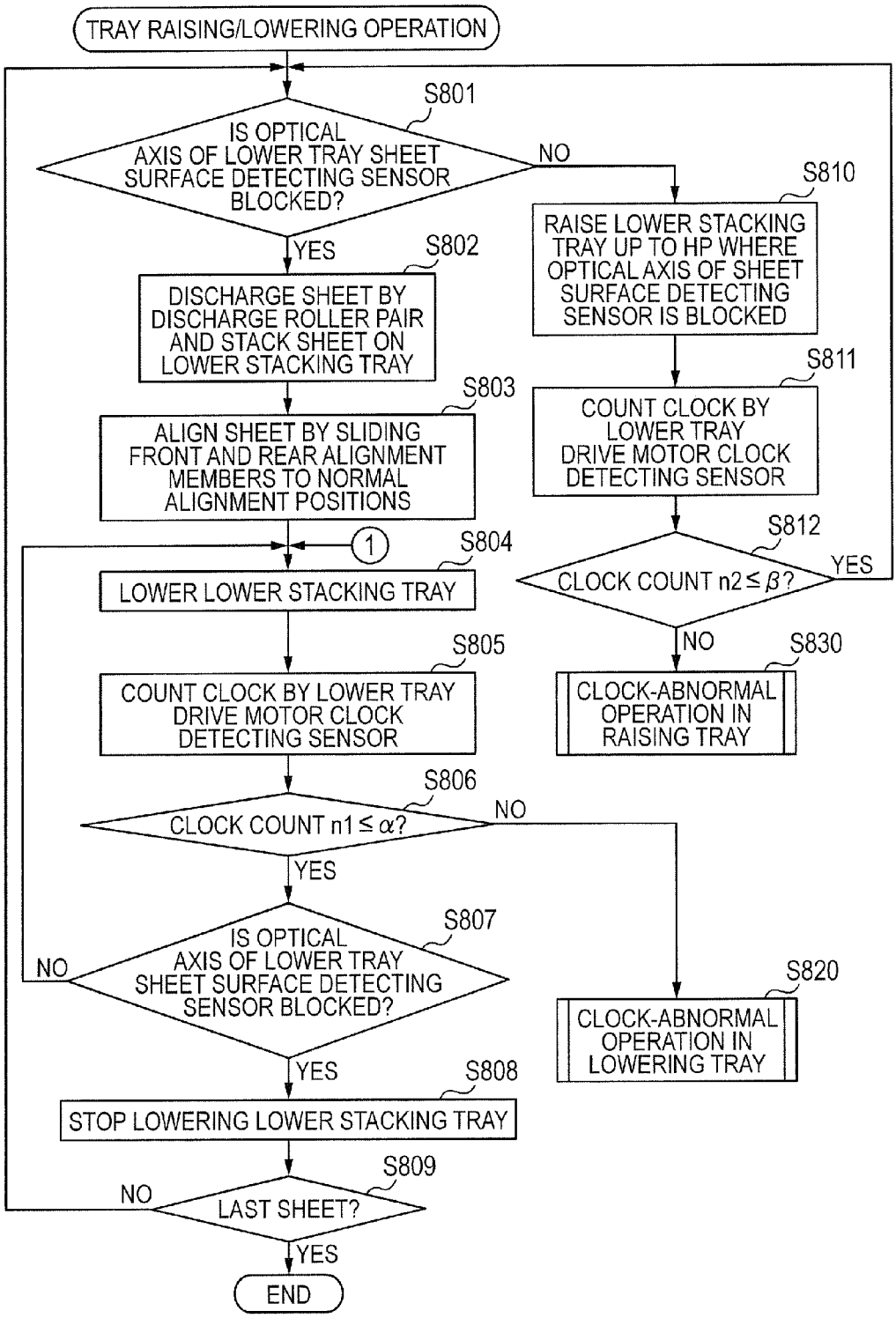
FIG. 10 is a flow chart illustrating an operation of stacking sheets onto the lower stacking tray of the finisher according to the embodiment.

Next, a sheet stacking operation to be performed by the finisher 500 according to this embodiment is described. In this embodiment, a lower tray stacking operation for stacking sheets onto the lower stacking tray 516 is described with reference to a flow chart of FIG. 10. Also in a case of stacking sheets onto the upper stacking tray 515, the finisher control portion 636 is capable of control to perform an operation similar to the following operation. FIG. 10 is a flow chart illustrating the operation of stacking sheets onto the lower stacking tray 516 of the finisher 500 according to this embodiment.

As illustrated in FIG. 10, when the user selects a non-binding, lower tray discharge/stack mode for stacking a sheet P onto the lower stacking tray 516 and the sheet P is fed from the copying machine 100 into the finisher 500, the sheet stacking operation for the lower stacking tray 516 is started. When the sheet stacking operation for the lower stacking tray 516 is started, after an initial operation of the lower stacking tray 516, it is first determined whether or not the optical axis of the lower tray sheet surface detecting sensor S5 is blocked (S801). That is, it is determined whether or not the lower stacking tray 516 is located at the home position. When the optical axis is blocked (the lower stacking tray 516 is located at the home position), the sheet P is discharged from the discharge roller pair 514 and stacked on the lower stacking tray 516 (S802). Then, the rear alignment member 519*a* and the front alignment member 519*b*, which are moved to their receiving positions set in accordance with a sheet size after the initial operation, are moved to alignment positions to execute the alignment control (S803).

It is desired that the sheet P is aligned at a timing when the rear alignment member 519*a* and the front alignment member 519*b* are driven under a state in which the sheet P is dropped onto the lower stacking tray 516. This is because the sheet stacking performance can further be enhanced if the sheet alignment operation is performed after the sheet P stops a flutter or the like that is caused when the sheet P is discharged from the discharge roller pair 514. In recent years, a copying machine has an increase in speed, and accordingly, if the alignment operation is performed after the sheet P is dropped onto the lower stacking tray 516, the rear alignment member 519*a* and the front alignment member 519*b* cannot sometimes be retreated to their receiving positions during a period in which a preceding sheet is aligned and then a succeeding sheet is discharged. Therefore, the succeeding sheet may collide against the rear alignment member 519*a* and the front alignment member 519*b*. To avoid this, in this embodiment, the sheet P is aligned by moving the rear alignment member 519*a* and the front alignment member 519*b* under a state in which the sheet P is held in a state of floating before dropping.

When the sheet P is aligned, in order to maintain a constant distance between the discharge roller pair 514 and the top surface position of the topmost sheet on the lower stacking tray 516, the lower tray drive motor M5 is driven to lower the lower stacking tray 516 until the optical axis of the lower tray sheet surface detecting sensor S5 appears (S804). That is, the raising/lowering control is executed. At this time, the lower tray drive motor clock detecting sensor S9 counts the clock of the lower tray drive motor M5 to monitor the lowering amount of the lower stacking tray 516 (S805 and S806).

A clock count n1 of the lower tray drive motor M5 at the time when the lower stacking tray 516 is lowered is a clock count to be obtained in a case where the lower stacking tray 516 is lowered until the optical axis of the lower tray sheet surface detecting sensor S5 appears from a state in which the optical axis is blocked. A value $\alpha$ indicates a predetermined lowering amount (predetermined movement amount) that is defined with reference to, for example, a lowering amount necessary to lower the lower stacking tray 516 until the optical axis of the lower tray sheet surface detecting sensor S5 is allowed to pass from a state in which the optical axis is blocked. Therefore, when the clock count n1 of the lower tray drive motor M5 at the time when the lower stacking tray 516 is lowered exceeds the value $\alpha$ ($n1>\alpha$), for example, the leading and trailing edges of the sheet may be curved upward, that is, the sheet may be brought into a concave gutter curl state, so that the optical axis of the lower tray sheet surface detecting sensor S5 is blocked. In this case, a gap may be formed between the lower stacking tray 516 and lower end surfaces of the rear alignment member 519*a* and the front alignment member 519*b*, and therefore control on the clock-abnormal operation in lowering the tray is executed (S820). The control on the clock-abnormal operation in lowering the tray is described later in detail.

For example, the value $\alpha$ is set as a predetermined lowering amount (movement amount) that is defined with reference to a maximum thickness d1 of a sheet bundle, which causes switching of the passage and block of the optical axis of the lower tray sheet surface detecting sensor S5 when a sheet bundle having a maximum processable thickness is stacked on the lower stacking tray 516. When the clock count n1 of the lower tray drive motor M5 at the time when the lower stacking tray 516 is lowered exceeds the value $\alpha$ ($n1>\alpha$), it is supposed that the lower stacking tray 516 is lowered to the degree greater than the maximum thickness d1 of a sheet bundle. For example, the trailing edge (upstream edge) side of the sheet P may lean on the abutment member. Also in this case, a gap may be formed between the lower stacking tray 516 and the lower end surfaces of the rear alignment member 519*a* and the front alignment member 519*b*, and therefore the control on the clock-abnormal operation in lowering the tray is executed (S820).

When the clock count n1 of the lower tray drive motor M5 at the time when the lower stacking tray 516 is lowered until the optical axis of the lower tray sheet surface detecting sensor S5 appears is equal to or less than the value $\alpha$ ($n1\leq\alpha$), the lower stacking tray 516 is stopped at the time when the optical axis appears (S807 and S808). Further, when the discharged sheet P is the last sheet, the job is ended, and when the discharged sheet P is not the last sheet, on the other hand, the process returns to S801 to repeat the above-mentioned operation.

When the optical axis of the lower tray sheet surface detecting sensor S5 is allowed to pass in S801, the lower tray drive motor M5 is driven to raise the lower stacking tray 516 until the optical axis of the lower tray sheet surface detecting sensor S5 of the lower stacking tray 516 is blocked (S810). At this time, the lower tray drive motor clock detecting sensor S9 counts the clock of the lower tray drive motor M5 to monitor the raising amount of the lower stacking tray 516 (S811 and S812).

A clock count n2 of the lower tray drive motor M5 at the time when the lower stacking tray 516 is raised is a clock count to be obtained in a case where the lower stacking tray 516 is raised until the optical axis of the lower tray sheet surface detecting sensor S5 is blocked from a state in which the optical axis is allowed to pass. A value $\beta$ indicates a predetermined raising amount (predetermined movement amount) that is defined with reference to a raising amount necessary to raise the lower stacking tray 516 until the optical axis of the lower tray sheet surface detecting sensor S5 is blocked from a state in which the optical axis is allowed to pass. Therefore, when the clock count n2 of the lower tray drive motor M5 at the time when the lower stacking tray 516 is raised exceeds the value $\beta$ ($n2>\beta$), it is supposed that the lower stacking tray 516 is raised more than necessary. For example, the user may take out a part or all of the sheets stacked on the lower stacking tray 516. In this case, a gap may be formed between the lower stacking tray 516 and the lower end portions of the rear alignment member 519*a* and the front alignment member 519*b*, and therefore control on the clock-abnormal operation in raising the tray is executed (S830). Note that, the control on the clock-abnormal operation in raising the tray is described later in detail.

When the clock count n2 at the time when the lower stacking tray 516 is raised until the optical axis of the lower tray sheet surface detecting sensor S5 is blocked is equal to or less than the value β (n2≤β), the lower stacking tray 516 is stopped at the time when the optical axis is blocked, and then the process proceeds to S801 (S812).

As described above, the clock is counted until the optical axis of the lower tray sheet surface detecting sensor S5 is allowed to pass or blocked, and the lower stacking tray 516 is raised or lowered while monitoring the raising amount or the lowering amount. In this manner, the raising/lowering control is performed so that the distance between the discharge roller pair 514 and the top surface position of the topmost sheet on the lower stacking tray 516 becomes constant. The raising/lowering control is repeated until the last sheet is stacked on the lower stacking tray 516, and the job is ended under a state in which the optical axis of the lower tray sheet surface detecting sensor S5 is allowed to pass eventually.

Figure 11:
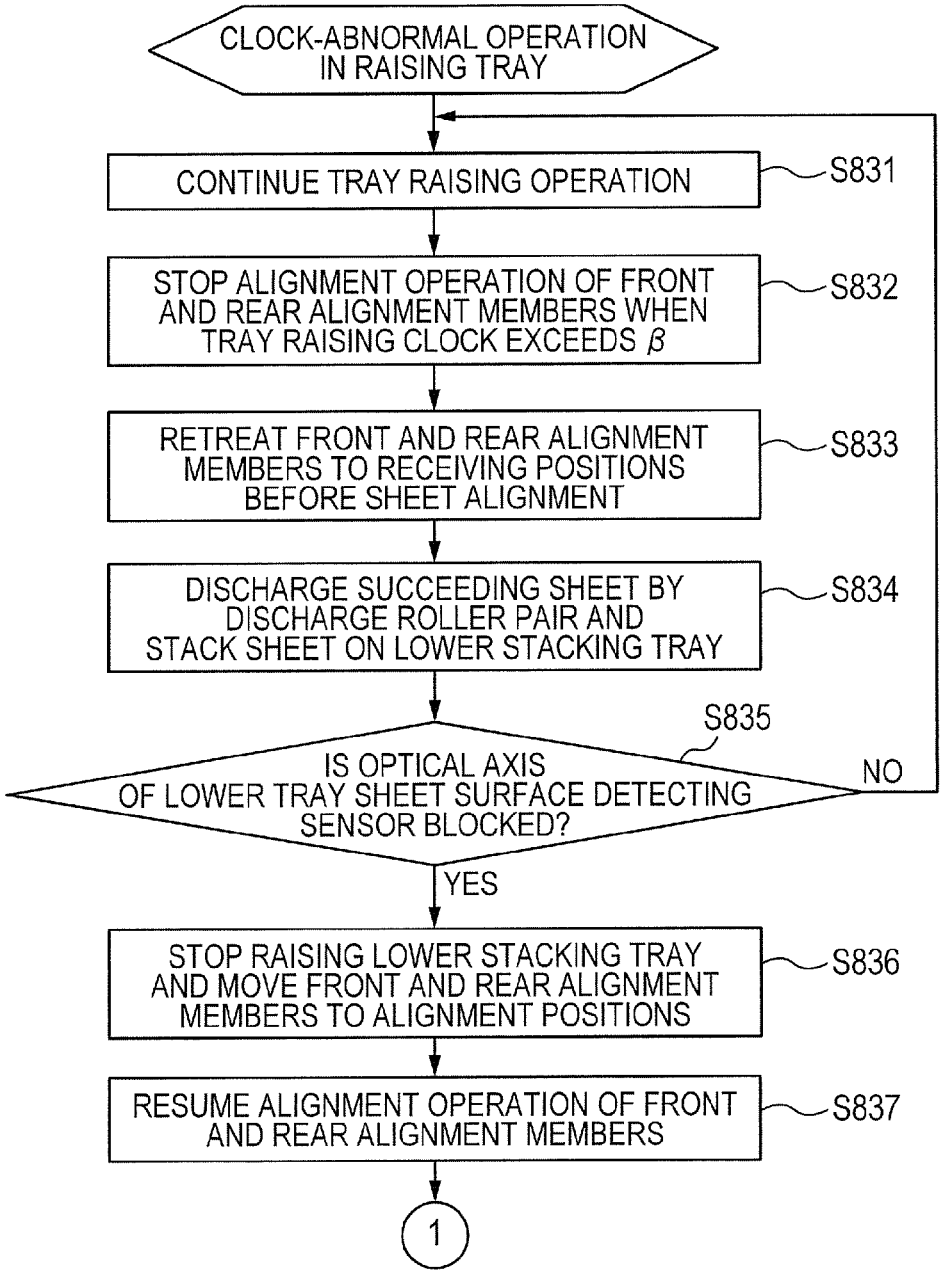
FIG. 11 is a flow chart illustrating an operation of stopping alignment at the time when a raising amount of the lower stacking tray exceeds a predetermined raising amount.
Figure 12A:
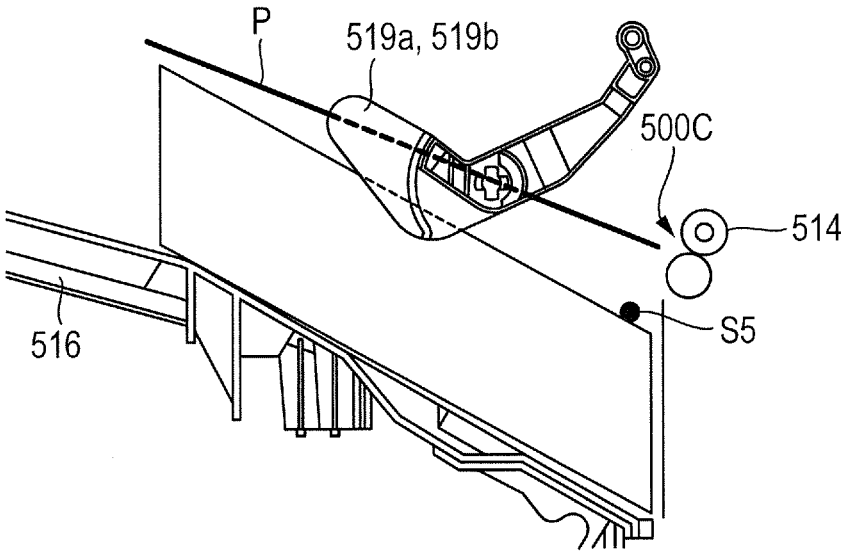
FIGS. 12A and 12B illustrate a relationship between the rear alignment member and a top surface position of the topmost sheet at the time when the raising amount of the lower stacking tray exceeds the predetermined raising amount.
Figure 12B:
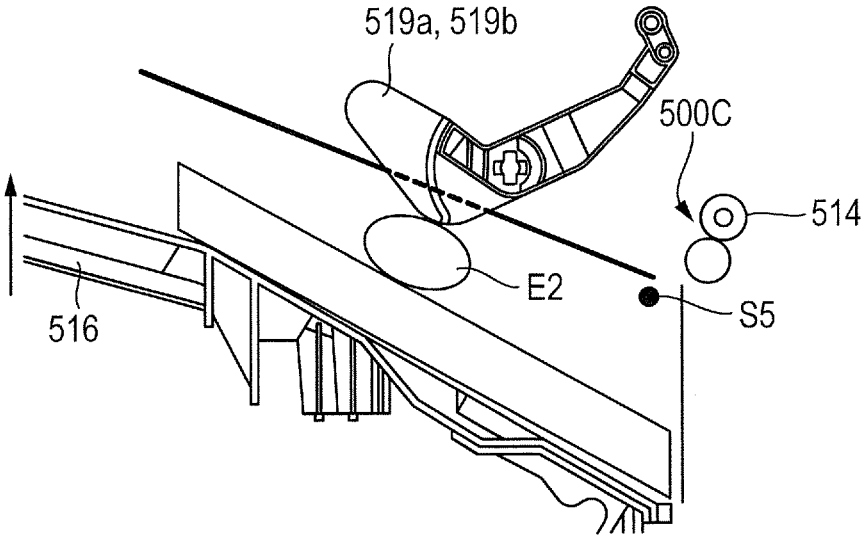
Figure 13A:
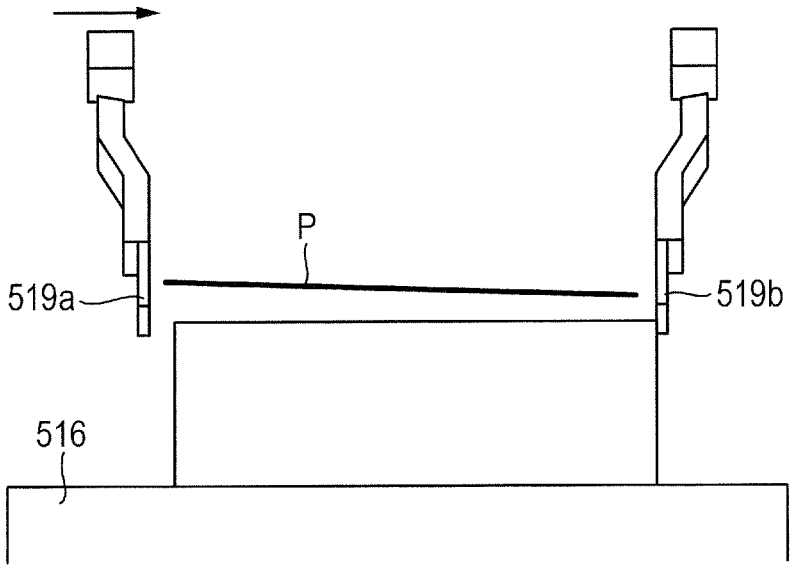
FIGS. 13A and 13B are views corresponding to FIGS. 12A and 12B as seen from a downstream side in a sheet discharge direction.
Figure 13B:
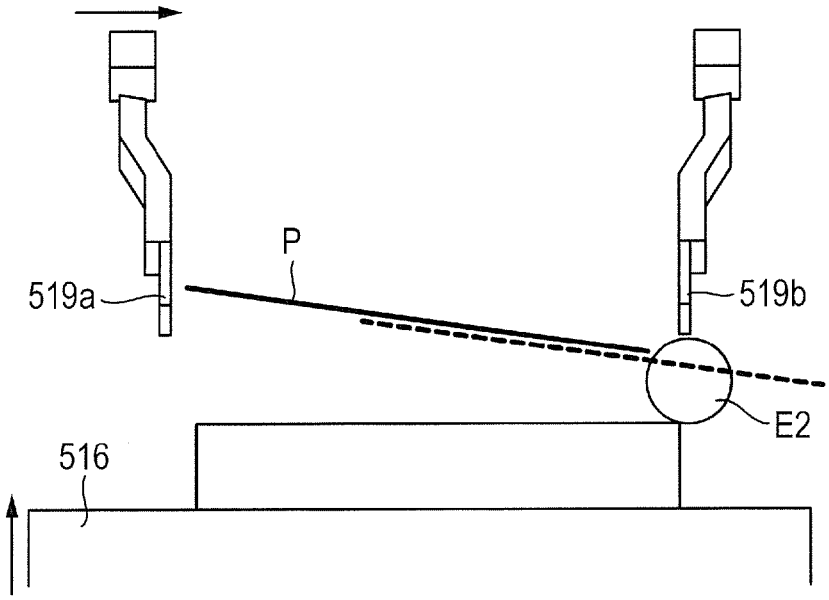

Next, the control on the clock-abnormal operation in raising the tray is described in detail along with a flow chart of FIG. 11 with reference to FIGS. 12A, 12B, 13A, and 13B. In this embodiment, the description is directed to the case where the user takes out a part of the stacked sheets while stacking the sheet and therefore the lower stacking tray 516 is raised over the predetermined raising amount. FIG. 11 is a flow chart illustrating an operation of stopping the alignment at the time when the lower stacking tray 516 raises and the raising amount thereof exceeds the predetermined raising amount. FIGS. 12A and 12B illustrate a relationship between the rear alignment member 519*a* and the top surface position of the topmost sheet at the time when the lower stacking tray 516 raises and the raising amount thereof exceeds the predetermined raising amount. FIGS. 13A and 13B are views corresponding to FIGS. 12A and 12B as seen from the downstream side in the sheet discharge direction.

When the user takes out a part of the sheets stacked on the lower stacking tray 516 so that the lower tray drive motor M5 is driven with its clock count n2 exceeding the value β, it is determined that the current operation corresponds to the clock-abnormal operation in raising the tray, and therefore the control on the clock-abnormal operation in raising the tray is executed. Specifically, first, when the clock count n2 of the lower tray drive motor M5 at the time when the lower stacking tray 516 is raised exceeds the value β, it is determined that the lower stacking tray 516 is located at a position lower than the normal position, and the alignment stop control is executed. In this embodiment, the alignment operation of the rear alignment member 519*a* and the front alignment member 519*b* is stopped (canceled) (S831 and S832), and then the rear alignment member 519*a* and the front alignment member 519*b* are retreated to their receiving positions (S833).

Also during this period, a sheet is discharged from the discharge roller pair 514, but the rear alignment member 519*a* and the front alignment member 519*b* are retreated to their receiving positions, and hence the alignment operation of the rear alignment member 519*a* and the front alignment member 519*b* is not performed. When the lower stacking tray 516 is then raised to the position at which the optical axis of the lower tray sheet surface detecting sensor S5 is blocked, the lower tray drive motor M5 is stopped so that the raising operation of the lower stacking tray 516 is stopped (S834 to S836). When the raising operation of the lower stacking tray 516 is stopped, the alignment operation of the rear alignment member 519*a* and the front alignment member 519*b* is resumed to align the sheet (S837), and the process returns to S804 described above. The alignment operation may be resumed by driving the rear alignment member 519*a* and the front alignment member 519*b* at the time when the lower stacking tray 516 is raised to the position at which the optical axis of the lower tray sheet surface detecting sensor S5 is blocked.

For example, as illustrated in FIGS. 12A, 12B, 13A, and 13B, when the user takes out a part or all of the sheets on the lower stacking tray 516 during the job, a gap E2 is formed between the lower stacking tray 516 and the lower end portions of the rear alignment member 519*a* and the front alignment member 519*b*. Under the above-mentioned state, when the rear alignment member 519*a* is to be moved to bring the discharged sheet P into abutment against the front alignment member 519*b* for alignment (one-sided alignment), the sheet P may enter the gap E2 between the front alignment member 519*b* and the stacked topmost sheet to cause stack misalignment of the sheet P. Further, the sheet P may slip out through the gap E2 to drop.

The finisher control portion 636 according to this embodiment executes the alignment stop control involving counting the clock of the lower tray drive motor M5 to monitor the raising amount of the lower stacking tray 516, and stopping the alignment operation of the lower tray alignment portion 518 at the time when the raising amount exceeds the predetermined raising amount. Therefore, the stack misalignment of the sheet P and the drop of the sheet P from the lower stacking tray 516 can be prevented. Accordingly, the stack misalignment of multiple sheets stacked on the lower stacking tray 516 and the like can be prevented.

Figure 14:
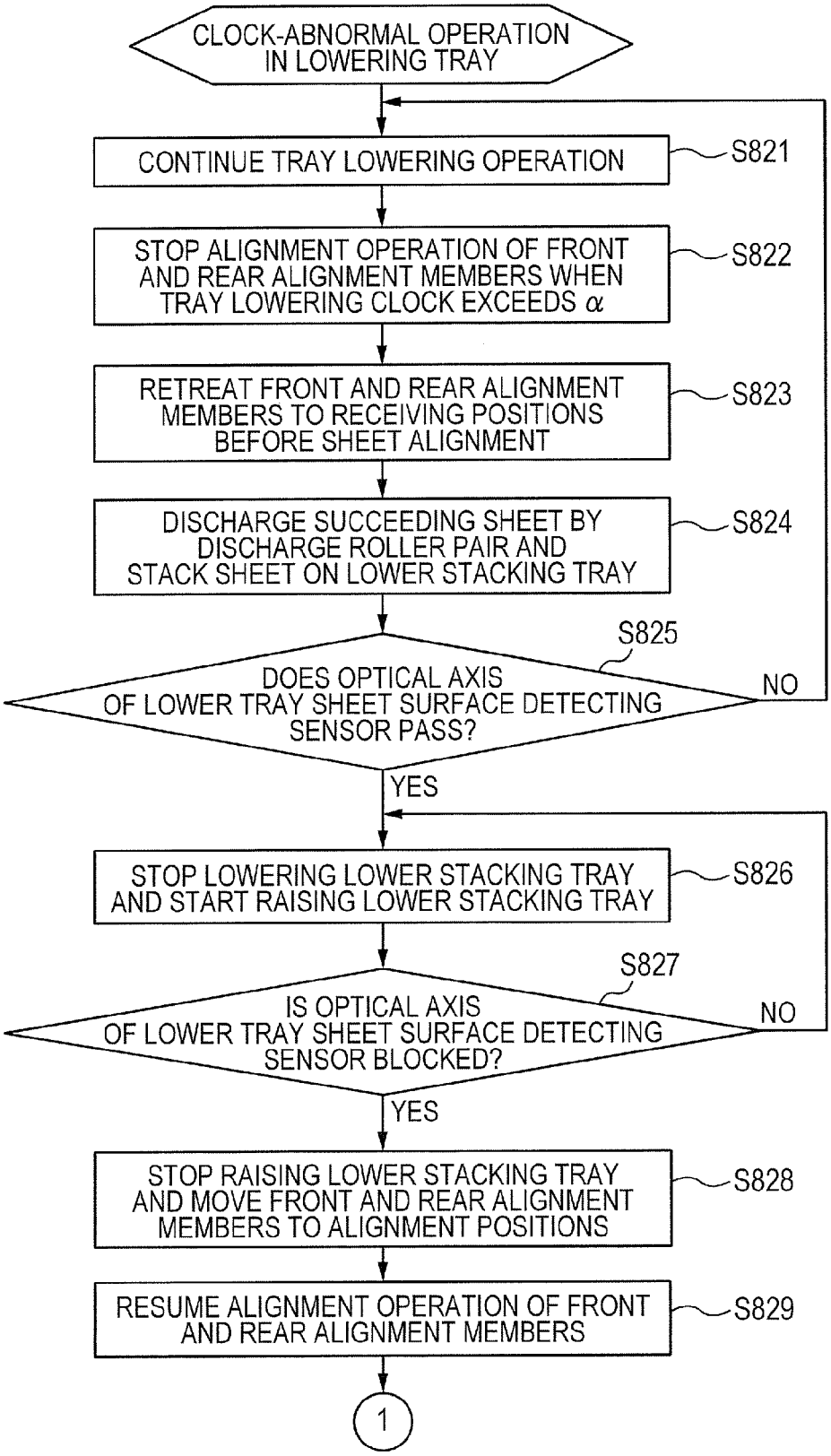
FIG. 14 is a flow chart illustrating an operation of stopping the alignment at the time when a lowering amount of the lower stacking tray exceeds a predetermined lowering amount.
Figure 15A:
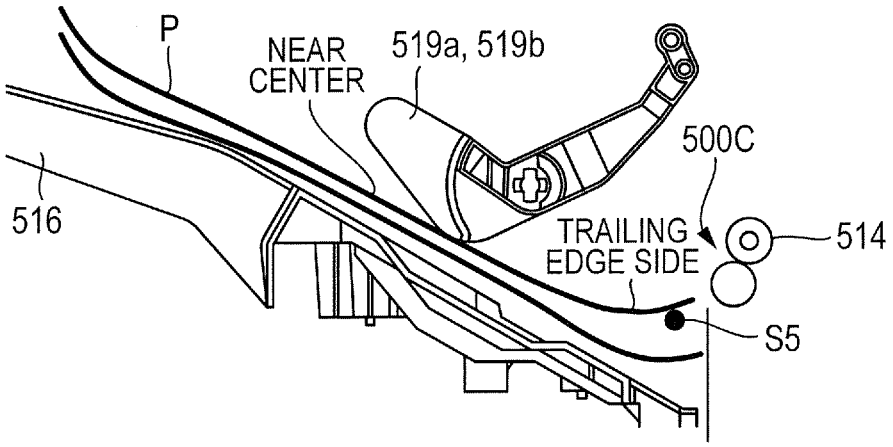
FIGS. 15A and 15B illustrate a relationship between the rear alignment member and the top surface position of the topmost sheet at the time when the lowering amount of the lower stacking tray exceeds the predetermined lowering amount.
Figure 15B:
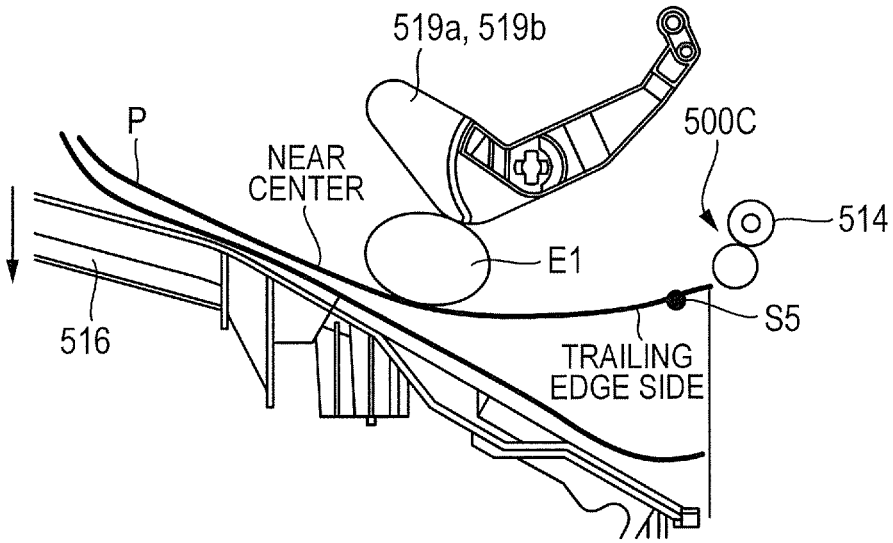
Figure 16A:
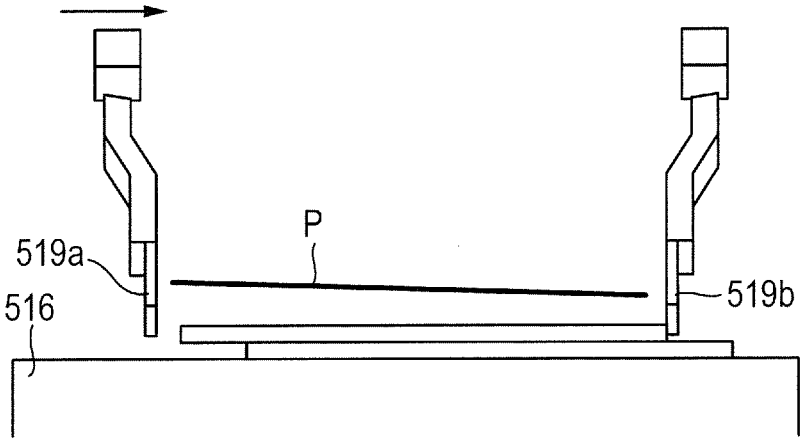
FIGS. 16A and 16B are views corresponding to FIGS. 15A and 15B as seen from the downstream side in the sheet discharge direction.
Figure 16B:
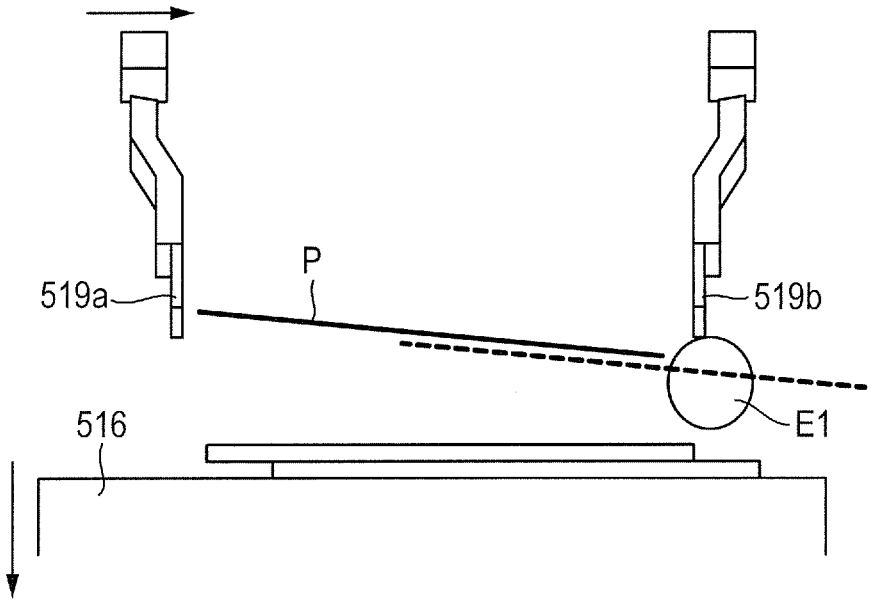

Next, the clock-abnormal operation in lowering the tray is described in detail along with a flow chart of FIG. 14 with reference to FIGS. 15A, 15B, 16A, and 16B. In this embodiment, the description is directed to the case where the sheet in the concave gutter curl state is stacked on the lower stacking tray 516 and therefore the trailing edge side blocks the optical axis of the lower tray sheet surface detecting sensor S5 so that the clock-abnormal operation in lowering the tray is detected. FIG. 14 is a flow chart illustrating an operation of stopping the alignment at the time when the lower stacking tray 516 lowers and the lowering amount thereof exceeds the predetermined lowering amount. FIGS. 15A and 15B illustrate a relationship between the rear alignment member 519*a* and the top surface position of the topmost sheet at the time when the lower stacking tray 516 lowers and the lowering amount thereof exceeds the predetermined lowering amount. FIGS. 16A and 16B are views corresponding to FIGS. 15A and 15B as seen from the downstream side in the sheet discharge direction.

When the trailing edge side of the sheet P in the concave gutter curl state blocks the optical axis of the lower tray sheet surface detecting sensor S5 so that the lower tray drive motor M5 is driven with its clock count n1 exceeding the value α, it is determined that the current operation corresponds to the clock-abnormal operation in lowering the tray, and therefore the control on the clock-abnormal operation in lowering the tray is executed. Specifically, first, when the clock count n1 of the lower tray drive motor M5 at the time when the lower stacking tray 516 is lowered exceeds the value α, it is determined that the lower stacking tray 516 is lowered downward more than necessary, and the alignment stop control is executed. In this embodiment, the alignment operation of the rear alignment member 519*a* and the front alignment member 519*b* is stopped (canceled) (S821 and S822), and then the rear alignment member 519*a* and the front alignment member 519*b* are retreated to their receiving positions (S823).

Also during this period, a sheet is discharged from the discharge roller pair 514, but the rear alignment member 519*a* and the front alignment member 519*b* are retreated to their receiving positions, and hence the alignment operation is not performed. Subsequently, it is determined whether or not the lower stacking tray 516 is located at a position at which the optical axis of the lower tray sheet surface detecting sensor S5 is allowed to pass. When the optical axis is allowed to pass, the lower tray drive motor M5 is stopped so that the lowering operation of the lower stacking tray 516 is stopped, and then the lower stacking tray 516 is raised (S824 to S826). When the optical axis of the lower tray sheet surface detecting sensor S5 is blocked through the raising operation of the lower stacking tray 516, the lower tray drive motor M5 is stopped so that the raising operation of the lower stacking tray 516 is stopped (S827 and S828). When the raising operation of the lower stacking tray 516 is stopped, the alignment operation of the rear alignment member 519*a* and the front alignment member 519*b* is resumed to align the sheet (S829), and the process returns to S804 described above. The alignment operation may be resumed by driving the rear alignment member 519*a* and the front alignment member 519*b* at the time when the lower stacking tray 516 is raised to the position at which the optical axis of the lower tray sheet surface detecting sensor S5 is blocked.

For example, as illustrated in FIGS. 15A, 15B, 16A, and 16B, when the sheet P is discharged with its leading and trailing edges curved upward, that is, in the concave gutter curl state, a difference in height of the stacking surface of the sheet P is generated between the trailing edge side of the sheet P and the portion near the center at which the rear alignment member 519*a* and the front alignment member 519*b* abut against the sheet P. When the difference in height is generated, a long period of time is required for the trailing edge side of the sheet P to drop onto the stacking surface, and further, the sheet P sometimes leans on a portion near a lower discharge port 500C of the finisher 500 as illustrated in FIG. 15B. At this time, the optical axis of the lower tray sheet surface detecting sensor S5 is blocked by the trailing edge side of the sheet P. Therefore, it is determined that the sheet is present, and accordingly the lower stacking tray 516 continues to be lowered. Therefore, the trailing edge side of the sheet P remains near the lower discharge port 500C, and the portion near the center at which the rear alignment member 519*a* and the front alignment member 519*b* abut against the sheet P is located at a lower position. Accordingly, as illustrated in FIGS. 15B and 16B, a gap E1 is formed between the stacked topmost sheet and the lower end portions of the rear alignment member 519*a* and the front alignment member 519*b*. Under the above-mentioned state, when the rear alignment member 519*a* is to be moved to bring the discharged sheet P into abutment against the front alignment member 519*b* for alignment (one-sided alignment), the sheet P may enter the gap E1 between the front alignment member 519*b* and the stacked topmost sheet to cause stack misalignment of the sheet P. Further, the sheet P may slip out through the gap E1 to drop.

The finisher control portion 636 according to this embodiment executes the alignment stop control involving counting the clock of the lower tray drive motor M5 to monitor the lowering amount of the lower stacking tray 516, and stopping the alignment operation of the lower tray alignment portion 518 at the time when the lowering amount exceeds the predetermined lowering amount. Therefore, the stack misalignment of the sheet P and the drop of the sheet P from the lower stacking tray 516 can be prevented. Accordingly, the stack misalignment of multiple sheets stacked on the lower stacking tray 516 and the like can be prevented.

The embodiment of the present invention has been described above, but the present invention is not limited to the embodiment described above. Further, the effects described in the embodiment of the present invention are exemplified only as the most suitable effects produced from the present invention, and hence the effects of the present invention are not limited to those described in the embodiment of the present invention.

For example, in this embodiment, when executing the alignment stop control, the alignment operation is stopped by stopping the movement of the rear alignment member 519*a* and the front alignment member 519*b*, but the present invention is not limited thereto. For example, the alignment operation may be stopped by reducing the movement amount of the rear alignment member 519*a* and the front alignment member 519*b* as compared to the movement amount at the time of the alignment control for controlling the rear alignment member 519*a* and the front alignment member 519*b* to sandwich the sheet. For example, they may be moved to positions at which they do not abut against both ends of the sheet in the width direction. A similar effect can be obtained also when the movement amount is reduced. The movement amount can be controlled by, for example, detecting the movement amount of the rear alignment member 519*a* and the front alignment member 519*b* from their home positions.

In this embodiment, the description is directed to the case of the one-sided alignment, in which the front alignment member 519*b* is fixed and the rear alignment member 519*a* is moved to align the sheet P stacked on the lower stacking tray 516, but the present invention is not limited thereto. For example, also in a case of two-sided alignment, in which both the front alignment member 519*b* and the rear alignment member 519*a* are moved to align the sheet, a similar effect can be obtained when the sheet is discharged while being displaced toward one of the alignment members.

For example, in this embodiment, the lower tray sheet surface detecting sensor S5 is provided below the discharge roller pair 514 so as to detect the trailing edge side of the sheet as a predetermined portion of the sheet, but the present invention is not limited thereto. In the case where the user takes out a part of the stacked sheets so that the raising amount exceeds the predetermined raising amount, the raising/lowering control may be performed so that the height of the top surface position at, for example, the center portion or leading edge side of the sheet becomes the predetermined height instead of the trailing edge side of the sheet.

In this embodiment, the finisher control portion 636 is mounted to the finisher 500, and the finisher control portion 636 is controlled by the CPU circuit portion 630 mounted to the copying machine 100 connected online. However, the present invention is not limited thereto. For example, the finisher control portion 636 may be mounted to the copying machine 100 integrally with the CPU circuit portion 630 so that the finisher 500 is controlled on the copying machine 100 side.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-103015, filed Apr. 27, 2012, which is hereby incorporated by reference herein in its entirety.

What is claimed is:

1. A sheet stacking apparatus, comprising:

a sheet discharge portion configured to discharge a sheet;

a stacking portion on which the sheet discharged by the sheet discharge portion is stacked;

a raising/lowering portion configured to raise or lower the stacking portion;

a detecting portion configured to detect a topmost sheet which is stacked on the stacking portion;

an alignment portion having a pair of alignment members arranged on both sides of the sheet on the stacking portion in a sheet width direction orthogonal to a sheet discharge direction, and the alignment portion performing an alignment operation in which at least one of the pair of alignment members moves to align the topmost sheet on the stacking portion; and a control portion configured to control the raising/lowering portion so that the topmost sheet is at a predetermined height in accordance with a detection result obtained from the detecting portion and configured to control the alignment portion to perform the alignment operation when the sheet is discharged by the sheet discharge portion, wherein the control portion is configured to control the alignment portion so as not to perform the alignment operation when the sheet is discharged by the sheet discharge portion in a case where the control portion determines that a movement amount of the stacking portion, at the time when the stacking portion is moved so that the topmost sheet is at the predetermined height in accordance with the detection result obtained from the detecting portion, exceeds a predetermined movement amount.

2. A sheet stacking apparatus according to claim 1, wherein the control portion is configured to control the alignment portion not to perform the alignment operation in a case that the stacking portion is raised so that the movement amount of the stacking portion exceeds the predetermined movement amount.

3. A sheet stacking apparatus according to claim 1, wherein the detecting portion is configured to detect a height of an upstream edge portion of the topmost sheet in the sheet discharge direction, and wherein the control portion is configured to control the alignment portion not to perform the alignment operation in a case that the stacking portion is lowered so that the movement amount of the stacking portion exceeds the predetermined movement amount.

4. A sheet stacking apparatus according to claim 1, wherein the control portion is configured to control the alignment portion to stop an operation of both of the pair of alignment members in a case where the control portion determines that the movement amount of the stacking portion exceeds the predetermined movement amount.

5. A sheet stacking apparatus according to claim 1, wherein the control portion is configured to control the alignment portion to set a movement amount of one of the pair of alignment members than a movement amount at the time of performing the alignment operation in a case where the control portion determines that the movement amount of the stacking portion exceeds the predetermined movement amount.

6. A sheet stacking apparatus according to claim 1, wherein the alignment portion is configured to align the sheet, which is discharged onto the stacking portion, in the sheet width direction by moving one of the pair of alignment members while fixing another of the pair of alignment members.

7. An image forming apparatus, comprising:

an image forming portion configured to form an image on a sheet;

a sheet discharge portion configured to discharge the sheet on which the image is formed by the image forming portion;

a stacking portion on which the sheet discharged by the sheet discharge portion is stacked;

a raising/lowering portion configured to raise or lower the stacking portion;

a detecting portion configured to detect a topmost sheet which is stacked on the stacking portion;

an alignment portion having a pair of first alignment members arranged on both sides of the sheet on the stacking portion in a sheet width direction orthogonal to a sheet discharge direction and the alignment portion performing an alignment operation in which at least one of the pair of alignment members moves to align the topmost sheet on the stacking portion; and a control portion configured to control the raising/lowering portion so that the topmost sheet is at a predetermined height in accordance with a detection result obtained from the detecting portion and configured to control the alignment portion to perform the alignment operation when the sheet is discharged by the sheet discharge portion, wherein the control portion is configured to control the alignment portion so as not to perform the alignment operation when the sheet is discharged by the sheet discharge portion in a case where the control portion determines that a movement amount of the stacking portion, at the time when the stacking portion is moved so that the topmost sheet is at the predetermined height in accordance with the detection result obtained from the detecting portion, exceeds a predetermined movement amount.

8. An image forming apparatus according to claim 7, wherein the control portion is configured to control the alignment portion not to perform the alignment operation in a case that the stacking portion is raised so that the movement amount of the stacking portion exceeds the predetermined movement amount.

9. An image forming apparatus according to claim 7, wherein the detecting portion is configured to detect a height of an upstream edge portion of the topmost sheet in the sheet discharge direction, and wherein the control portion is configured to control the alignment portion not to perform the alignment operation in a case that the stacking portion is lowered so that the movement amount of the stacking portion exceeds the predetermined movement amount.

10. An image forming apparatus according to claim 7, wherein the control portion is configured to control the alignment portion to stop an operation of both of the pair of alignment members in a case where the control portion determines that the movement amount of the stacking portion exceeds the predetermined movement amount.

11. An image forming apparatus according to claim 7, wherein the control portion is configured to control the alignment portion to set a movement amount of one of the pair of alignment members smaller than a movement amount at the time of performing the alignment operation in a case where the control portion determines that the movement amount of the stacking portion exceeds the predetermined movement amount.

12. An image forming apparatus according to claim 7, wherein the alignment portion is configured to align the sheet, which is discharged onto the stacking portion, in the sheet width direction by moving one of the pair of alignment members while fixing another of the pair of alignment members.

13. A sheet stacking apparatus according to claim 1, wherein the raising/lowering portion includes a motor which generates driving force to raise or lower the stacking portion, and wherein the control portion is configured to determine that the movement amount of the stacking portion exceeds the predetermined movement amount based on a clock of the motor.

14. A sheet stacking apparatus according to claim 1, wherein the control portion is configured to control the alignment portion to resume the alignment operation after the detecting portion generates a signal which indicates that the topmost sheet reaches the predetermined height.

15. A sheet stacking apparatus, comprising:

a sheet discharge portion configured to discharge a sheet;

a stacking portion on which the sheet discharged from the sheet discharge portion is stacked, and which is capable of raising or lowering;

a detecting portion configured to detect a topmost sheet which is stacked on the stacking portion;

an alignment portion having a pair of alignment members arranged on both sides of the sheet on the stacking portion in a sheet width direction orthogonal to a sheet discharge direction, and the alignment portion performing an alignment operation in which at least one of the pair of alignment members moves to align the topmost sheet on the stacking portion; and a control portion configured to control a movement of the stacking portion so that the topmost sheet is at a predetermined height in accordance with a detection result obtained from the detecting portion and also configured to control the alignment portion to perform the alignment operation during a discharge operation in which a plurality of sheets is continuously discharged one by one by the sheet discharge portion, wherein the control portion is configured to control the alignment portion so as not to perform the alignment operation in a case where the sheet stacked on the stacking portion is removed during the discharge operation.

16. A sheet stacking apparatus according to claim 15, wherein the control portion is configured to control the alignment portion to resume the alignment operation after the stacking portion rises until the detecting portion detects the topmost sheet.

17. A sheet stacking apparatus according to claim 15, further comprising a raising/lowering portion including a motor which generates driving force to raise or lower the stacking portion, and a determining portion which determines that, the sheet stacked on the stacking portion is removed during the discharge operation, based on a clock of the motor.

18. A sheet stacking apparatus according to claim 15, wherein the control portion is configured to determine that, the sheet stacked on the stacking portion is removed during the discharge operation, in a case that the stacking portion is raised so that a movement amount of the stacking portion, at the time when the stacking portion is moved in accordance with the detection result obtained from the detecting portion, exceeds a predetermined movement amount.

19. A sheet stacking apparatus according to claim 15, wherein the control portion is configured to control the alignment portion not to move both of the pair of alignment members in the case that the sheet stacked on the stacking portion is removed during the discharge operation.

20. A sheet stacking apparatus according to claim 15, wherein the control portion is configured to control the alignment portion to set a movement amount of one of the pair of alignment members smaller than a movement amount at the time of performing the alignment operation in the case that the sheet stacked on the stacking portion is removed during the discharge operation.

21. A sheet stacking apparatus according to claim 15, wherein the stacking portion is raised or lowered relative to the pair of alignment members.

22. A sheet stacking apparatus, comprising:

a sheet discharge portion configured to discharge a sheet;

a stacking portion on which the sheet discharged by the sheet discharge portion is stacked, and which is capable of lowering;

a detecting portion configured to detect a topmost sheet which is stacked on the stacking portion;

an alignment portion configured to align the sheet on the stacking portion and having a pair of alignment members arranged on both sides of the sheet on the stacking portion in a sheet width direction orthogonal to a sheet discharge direction; and a control portion configured to control a movement of the stacking portion so that the topmost sheet is at a predetermined height in accordance with a detection result obtained from the detecting portion and also configured to control a movement of at least one of the pair of alignment members to align the sheet on the stacking portion, wherein the control portion is configured to control the alignment portion so as not to align a sheet discharged to the stacking portion by the sheet discharge portion in a case where the sheet stacked on the stacking portion is removed.

23. A sheet stacking apparatus according to claim 22, wherein the control portion is configured to control the alignment portion to resume to align the sheet on the stacking portion after the stacking portion rises until the detecting portion detects the topmost sheet.

24. A sheet stacking apparatus according to claim 22, further comprising a raising/lowering portion including a motor which generates driving force to raise or lower the stacking portion, and a determining portion which determines that, the sheet stacked on the stacking portion is removed, based on a clock of the motor.

25. A sheet stacking apparatus according to claim 22, wherein the control portion is configured to determine that, the sheet stacked on the stacking portion is removed, in a case that the stacking portion is raised so that a movement amount of the stacking portion, at the time when the stacking portion is moved in accordance with the detection result obtained from the detecting portion, exceeds a predetermined movement amount.

26. A sheet stacking apparatus according to claim 22, wherein the control portion is configured to control the alignment portion not to move both of the pair of alignment members in the case that the sheet stacked on the stacking portion is removed.

27. A sheet stacking apparatus according to claim 22, wherein the control portion is configured to control the alignment portion to set a movement amount of one of the pair of alignment members smaller than a movement amount at the time of aligning the sheet in the case that the sheet stacked on the stacking portion is removed.

28. A sheet stacking apparatus according to claim 22, wherein the stacking portion is lowered relative to the pair of alignment members.

29. A sheet stacking apparatus according to claim 22, wherein the alignment portion aligns the sheet on the stacking portion by pushing an edge of the sheet on the stacking portion by at least one of pair of alignment members.

30. A sheet stacking apparatus according to claim 22, wherein the stacking portion is configured to be capable of raising, and wherein the control portion is configured to control the alignment portion to resume to align the sheet on the stacking portion after the stacking portion rises.

31. A sheet stacking apparatus according to claim 22, wherein the control portion controls the alignment portion so as not to align the sheet on the stacking portion even if a sheet is discharged onto the stacking portion in the case where the sheet stacked on the stacking portion is removed.

* * * * *